US008613149B2

(12) United States Patent
Schwirian

(10) Patent No.: US 8,613,149 B2
(45) Date of Patent: Dec. 24, 2013

(54) FOOTWEAR INCORPORATING A COMPOSITE SHELL SOLE STRUCTURE

(75) Inventor: David Edward Schwirian, Portland, OR (US)

(73) Assignee: Nike, Inc., Beaverton, OR (US)

( * ) Notice: Subject to any disclaimer, the term of this patent is extended or adjusted under 35 U.S.C. 154(b) by 1003 days.

(21) Appl. No.: 12/615,975

(22) Filed: Nov. 10, 2009

(65) Prior Publication Data

US 2011/0107622 A1 May 12, 2011

(51) Int. Cl.
*A43B 5/00* (2006.01)
*A43B 5/14* (2006.01)

(52) U.S. Cl.
USPC ..... 36/30 A; 36/30 R; 36/103

(58) Field of Classification Search
USPC ..... 36/30 A, 30 R, 103, 15, 31
See application file for complete search history.

(56) References Cited

U.S. PATENT DOCUMENTS

| | | | | | |
|---|---|---|---|---|---|
| 2,099,418 | A | * | 11/1937 | Bradley et al. | 36/11.5 |
| 4,228,600 | A | * | 10/1980 | Krug et al. | 36/32 R |
| 4,246,707 | A | * | 1/1981 | Pedersen | 36/100 |
| 4,481,726 | A | * | 11/1984 | Phillips | 36/30 A |
| 4,654,983 | A | * | 4/1987 | Graham et al. | 36/30 R |
| 4,662,090 | A | * | 5/1987 | Solano | 36/131 |
| 4,787,100 | A | * | 11/1988 | Jonat | 2/80 |
| 4,864,738 | A | | 9/1989 | Horovitz | |
| 4,876,808 | A | * | 10/1989 | Hsieh | 36/131 |
| 4,899,467 | A | | 2/1990 | Mackey | |
| 5,086,576 | A | * | 2/1992 | Lamson | 36/131 |
| 5,390,430 | A | | 2/1995 | Fitchmun et al. | |
| 5,406,723 | A | * | 4/1995 | Okajima | 36/131 |
| 5,477,577 | A | | 12/1995 | Hadley | |
| 5,555,584 | A | * | 9/1996 | Moore et al. | 12/142 N |
| 5,595,003 | A | | 1/1997 | Snow | |
| 5,611,152 | A | | 3/1997 | Richard et al. | |
| 5,832,634 | A | | 11/1998 | Wong | |
| 5,836,094 | A | | 11/1998 | Figel | |
| 5,875,567 | A | | 3/1999 | Bayley | |
| 6,665,956 | B2 | | 12/2003 | Hay | |
| 6,922,916 | B1 | * | 8/2005 | Potter et al. | 36/31 |
| 6,938,362 | B2 | * | 9/2005 | Saillet et al. | 36/117.3 |
| 7,028,418 | B1 | * | 4/2006 | Huang | 36/12 |
| 7,032,329 | B2 | | 4/2006 | Yang | |
| 7,418,792 | B2 | | 9/2008 | Pai | |
| 7,530,181 | B2 | | 5/2009 | Joynt et al. | |

(Continued)

FOREIGN PATENT DOCUMENTS

| | | |
|---|---|---|
| EP | 1442670 | 8/2004 |
| EP | 1685772 | 8/2006 |

OTHER PUBLICATIONS

International Search Report and Written Opinion for PCT Application No. PCT/US 2010/051153, mailed Mar. 16, 2011.

*Primary Examiner* — Jila M Mohandesi
(74) *Attorney, Agent, or Firm* — Plumsea Law Group, LLC

(57) ABSTRACT

An article of footwear has an upper and a sole structure secured to the upper. The sole structure includes a shell and a core. The shell has a ground portion and a footbed portion, with a periphery of the footbed portion being secured to the ground portion to define a cavity between the ground portion and the footbed portion. The core is located within the cavity. Whereas the shell may be formed from a composite material, the core may be formed from a polymer foam material.

22 Claims, 39 Drawing Sheets

(56) References Cited

U.S. PATENT DOCUMENTS

| | | | | |
|---|---|---|---|---|
| 7,533,480 | B2 * | 5/2009 | Chao et al. | 36/131 |
| 7,549,232 | B2 * | 6/2009 | Tadin | 33/515 |
| 8,151,486 | B2 * | 4/2012 | Dua | 36/29 |
| 2005/0116380 | A1 * | 6/2005 | Tadin | 264/223 |
| 2006/0080863 | A1 | 4/2006 | Pai | |
| 2007/0062065 | A1 | 3/2007 | Wang et al. | |
| 2008/0184601 | A1 | 8/2008 | Hsieh | |
| 2009/0064535 | A1 | 3/2009 | Spanks et al. | |

* cited by examiner

FOOTWEAR INCORPORATING A COMPOSITE SHELL SOLE STRUCTURE

BACKGROUND

Articles of footwear generally include two primary elements, an upper and a sole structure. The upper is often formed from a plurality of elements (e.g., textiles, foam, leather, synthetic leather) that are stitched or adhesively bonded together to form an interior void for securely and comfortably receiving a foot. The sole structure is secured to a lower areas of the upper and effectively extends between the foot and the ground.

Depending upon the intended use for an article of footwear, the overall configuration of the upper and the sole structure may vary considerably. For example, footwear utilized for running (i.e., jogging) may incorporate a compressible and flexible sole structure, which is often formed from a polymer foam material, and may also include a variety of additional footwear elements that enhance the comfort or performance of the footwear, including moderators, fluid-filled chambers, lasting elements, or motion control members. Footwear utilized for sprinting may also impart some compressibility, but sometimes has a low-profile and stiffer configuration that is beneficial during a sprint. Other articles of footwear, such as cycling shoes, may benefit from more rigid configurations. Cycling shoes are utilized during cycling competitions, training sessions, and recreational rides to interface with bicycle pedals. In order to efficiently transfer energy from a rider to the pedals, cycling shoes often incorporate rigid plates and mounting hardware for a cleat or other device that interfaces with the pedals. Snowboarding, skiing, and motorcycle boots may also incorporate rigid sole structures. Accordingly, depending upon the intended purpose for an article of footwear, the sole structure may range from compliant and compressible to rigid.

SUMMARY

Various articles of footwear are disclosed below. In one configuration, the footwear has an upper and a sole structure secured to the upper. The sole structure includes a shell and a core. The shell has a ground portion and a footbed portion, with a periphery of the footbed portion being secured to the ground portion to define a cavity between the ground portion and the footbed portion. The core is located within the cavity. Whereas the shell may be formed from a composite material, the core may be formed from a polymer foam material.

In another configuration, a sole structure includes a shell formed from a composite material including a polymer matrix and fiber reinforcement with a tensile strength greater than 0.60 gigapascals. The shell defines an interior cavity, and a core formed from a polymer foam material is located within the cavity and substantially fills the cavity. In a further configuration, a sole structure has a vertical thickness consisting of (a) two shell layers formed from a composite material and (b) a core layer located between the shell layers, a majority of the core layer being formed from a polymer foam material.

In manufacturing the article of footwear, a first shell portion may be formed from a composite material to have a concave surface that defines a depression. A polymer foam material is located within the depression and imparts a contour to an exposed surface of the polymer foam material. A second shell portion is formed from the composite material and imparts the contour to an exposed surface of the second shell portion. The second shell portion is joined to the first shell portion to enclose the polymer foam material between the first shell portion and the second shell portion. Additionally, at least one of the first shell portion and the second shell portion are secured to the upper.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
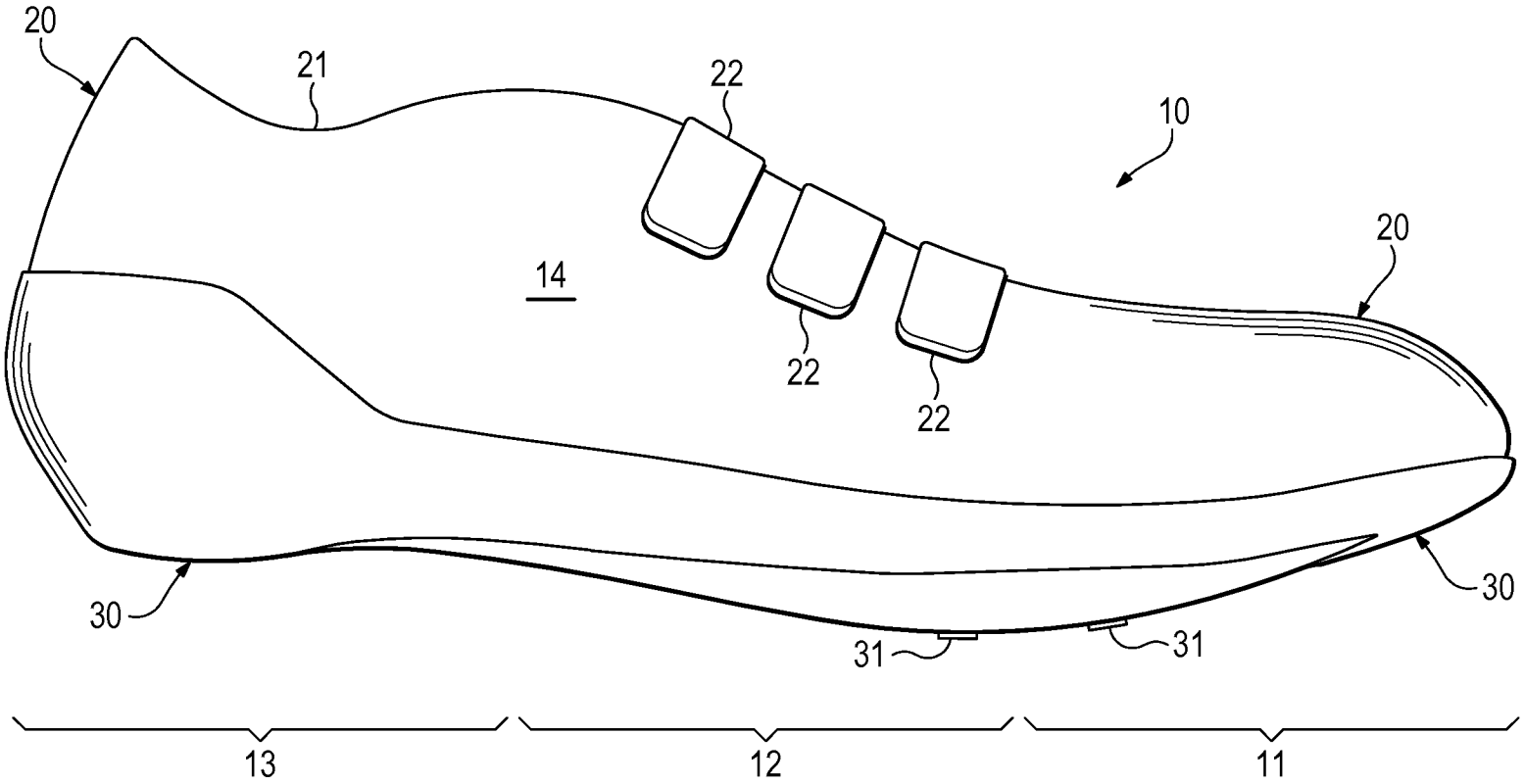
FIG. 1 is lateral side elevational view of an article of footwear.
Figure 2:
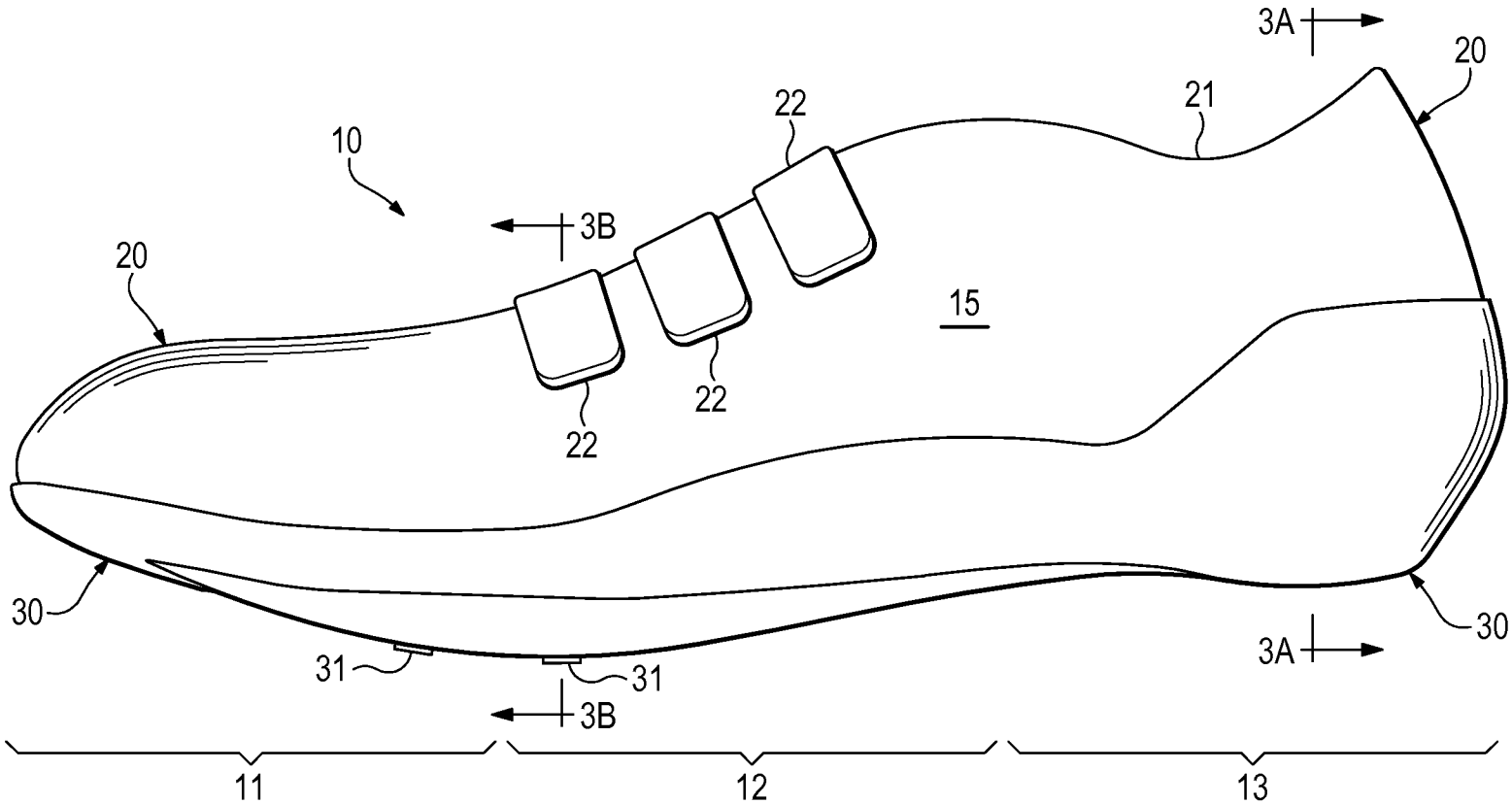
FIG. 2 is a medial side elevational view of the article of footwear.
Figure 3A:
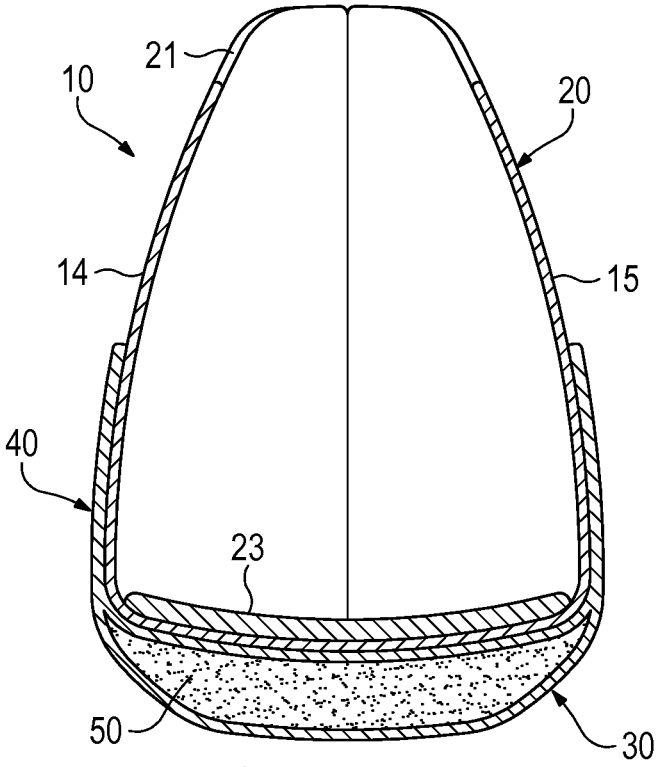
FIGS. 3A and 3B are cross-sectional views of the article of footwear, as defined by section lines 3A and 3B in FIG. 2.
Figure 3B:
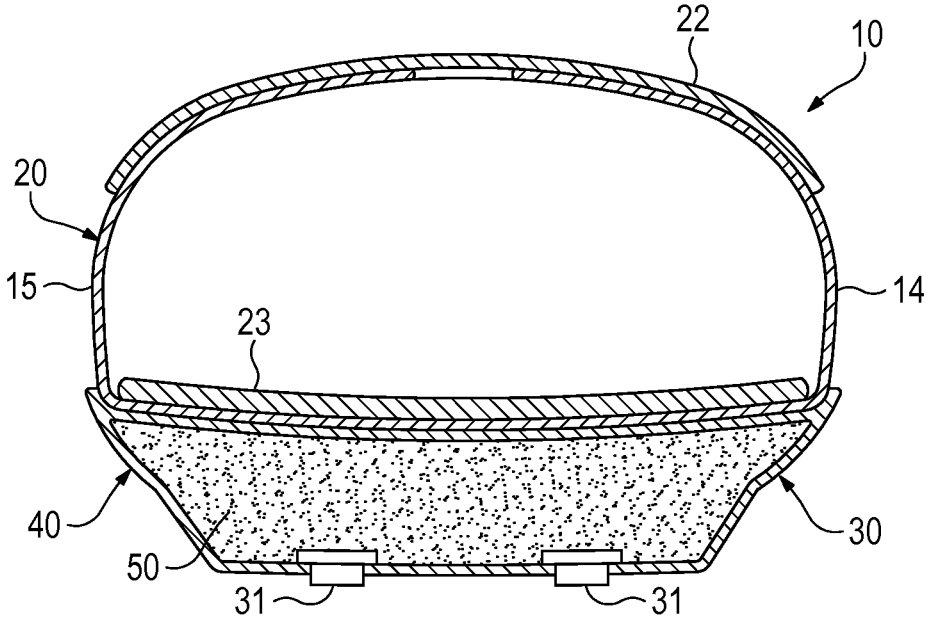
Figure 4:
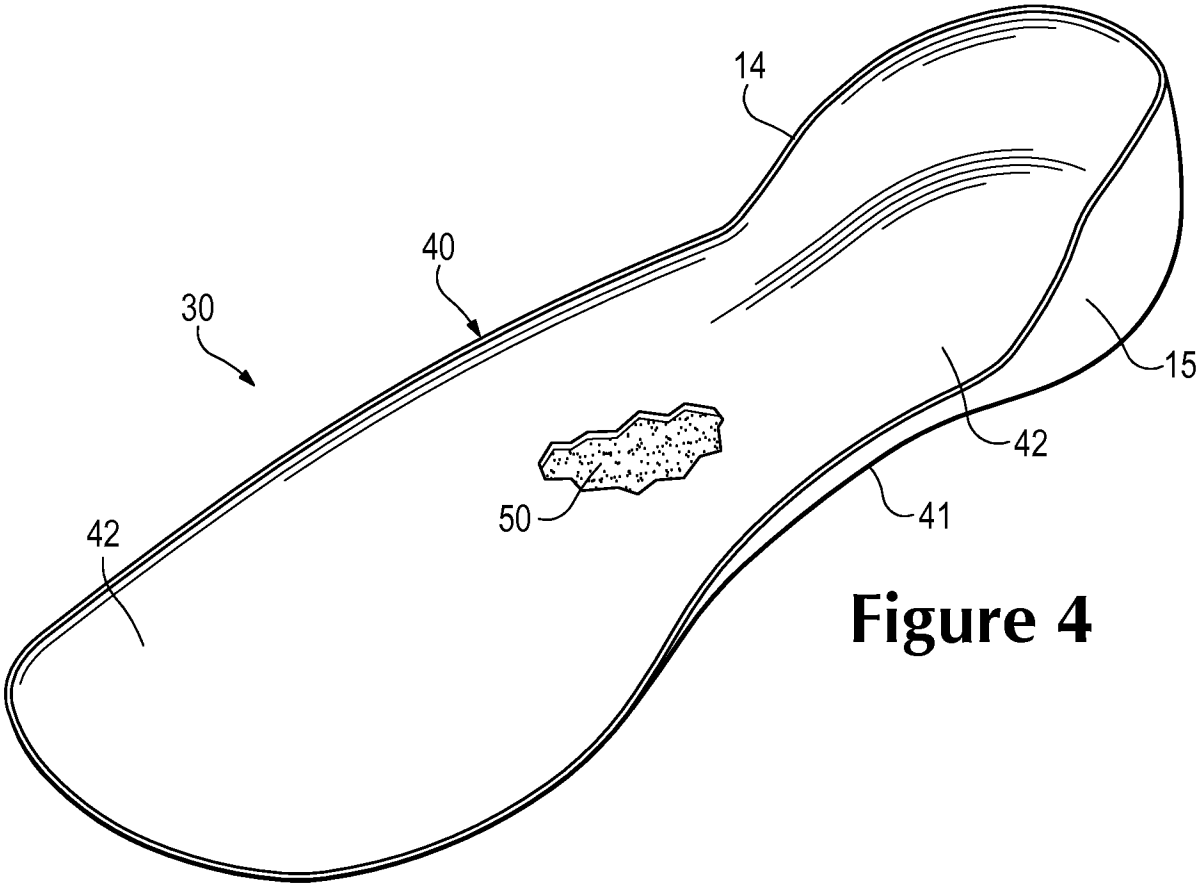
FIG. 4 is a perspective view of a sole structure from the article of footwear.
Figure 5:
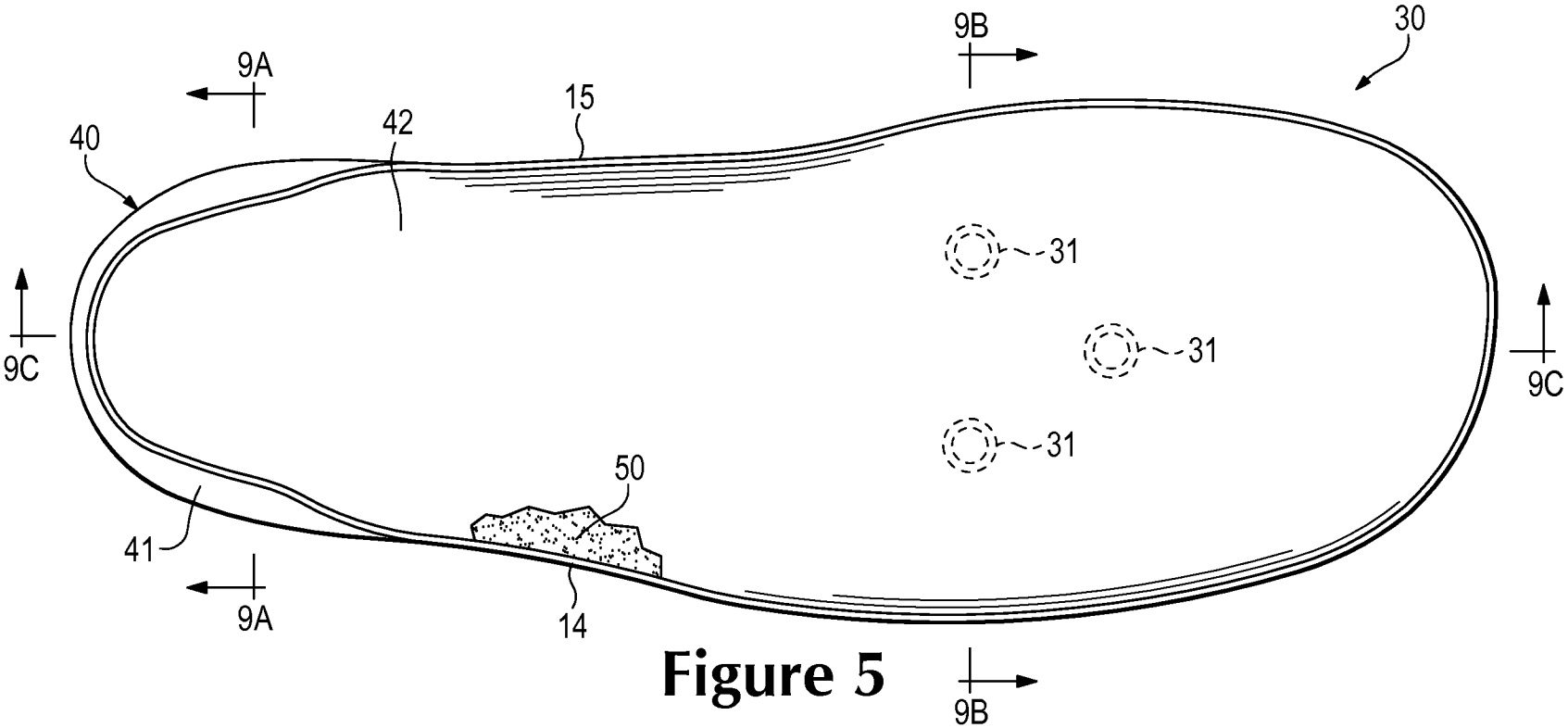
FIG. 5 is a top plan view of the sole structure.
Figure 6:
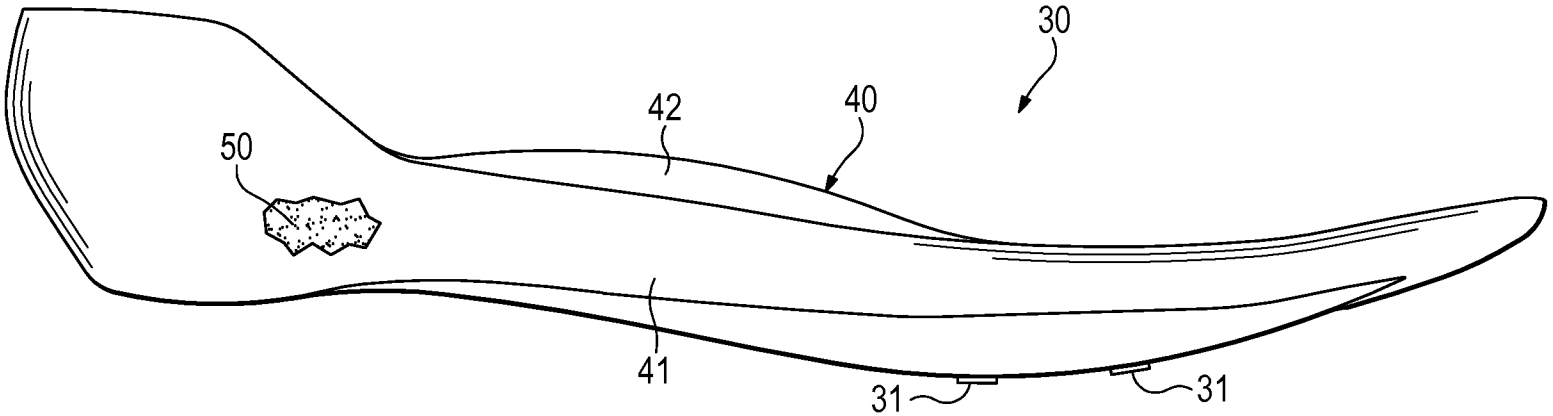
FIG. 6 is a lateral side elevational view of the sole structure.
Figure 7:
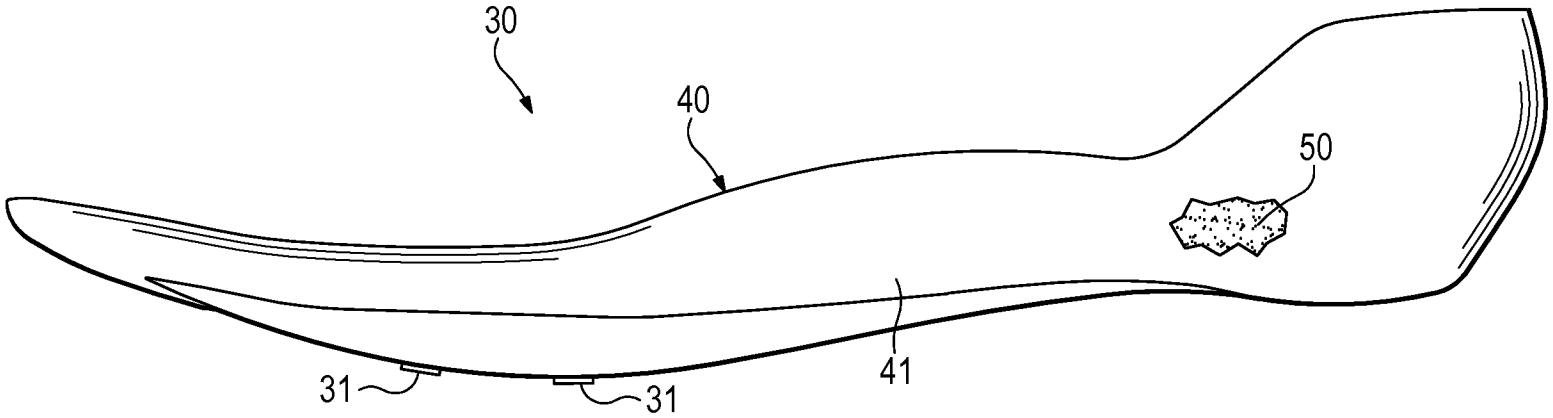
FIG. 7 is a medial side elevational view of the sole structure.
Figure 8:
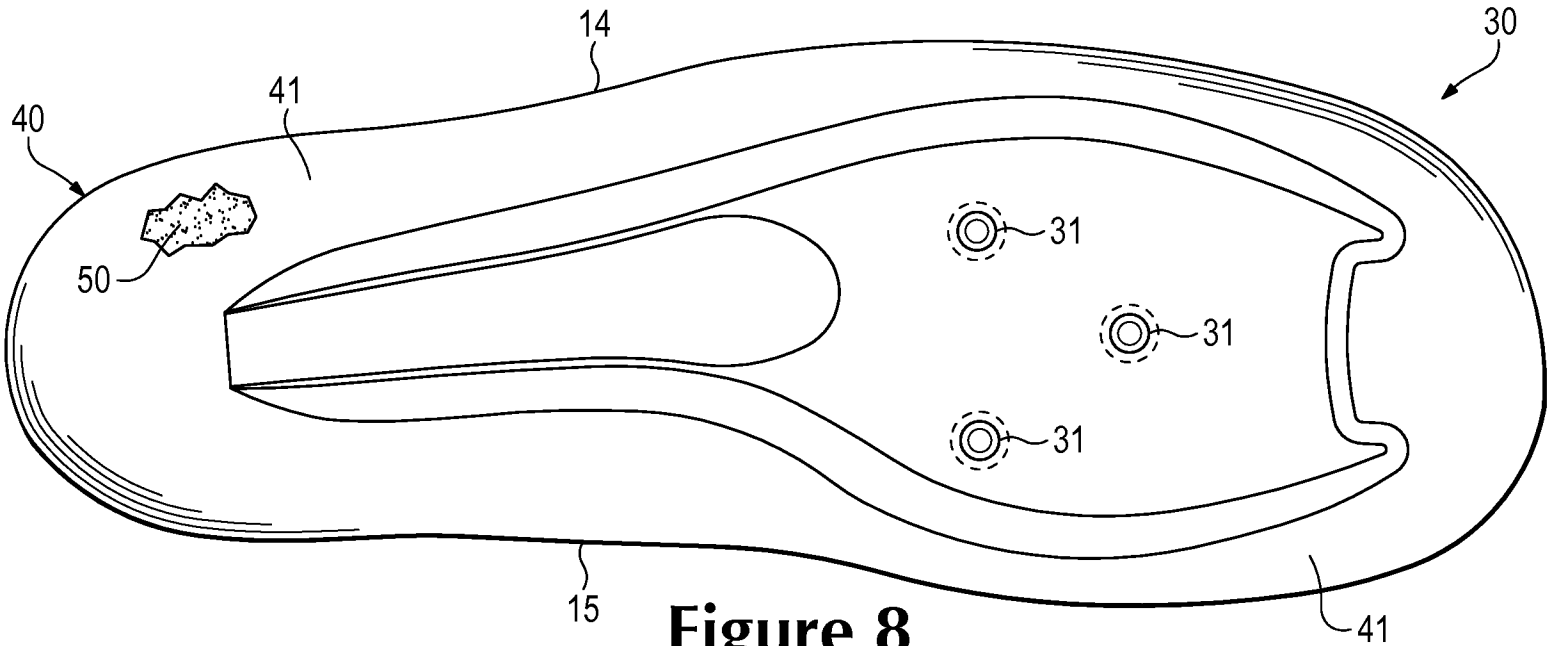
FIG. 8 is a bottom plan view of the sole structure.
Figure 9A:
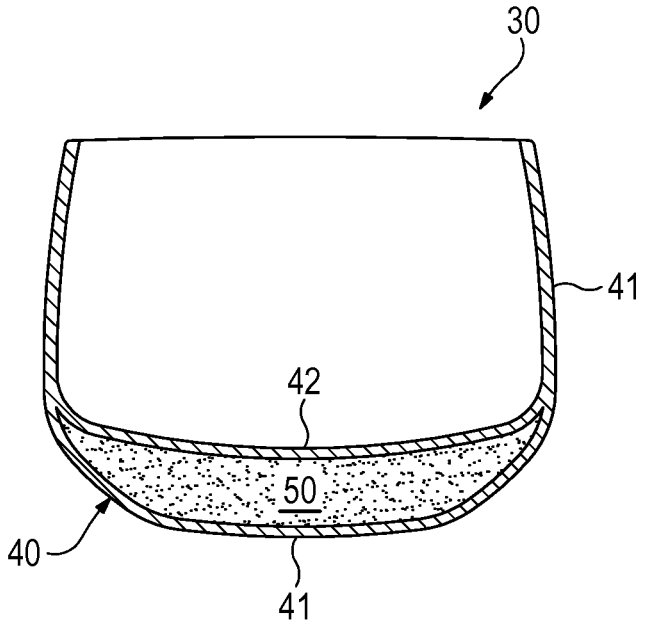
FIGS. 9A-9C are cross-sectional views of the sole structure, as defined by section lines 9A-9C in FIG. 5.
Figure 9B:
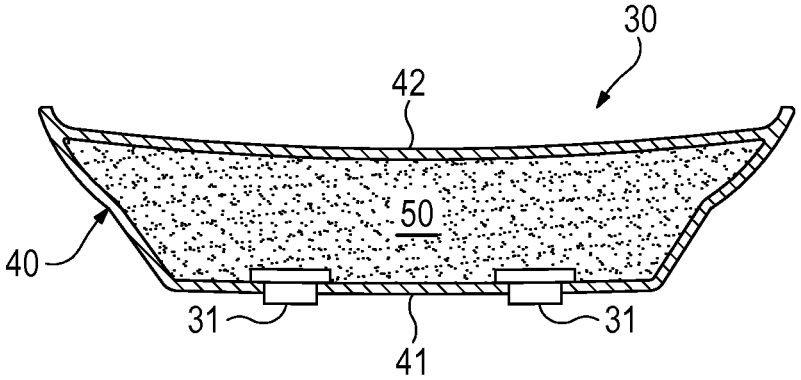
Figure 9C:
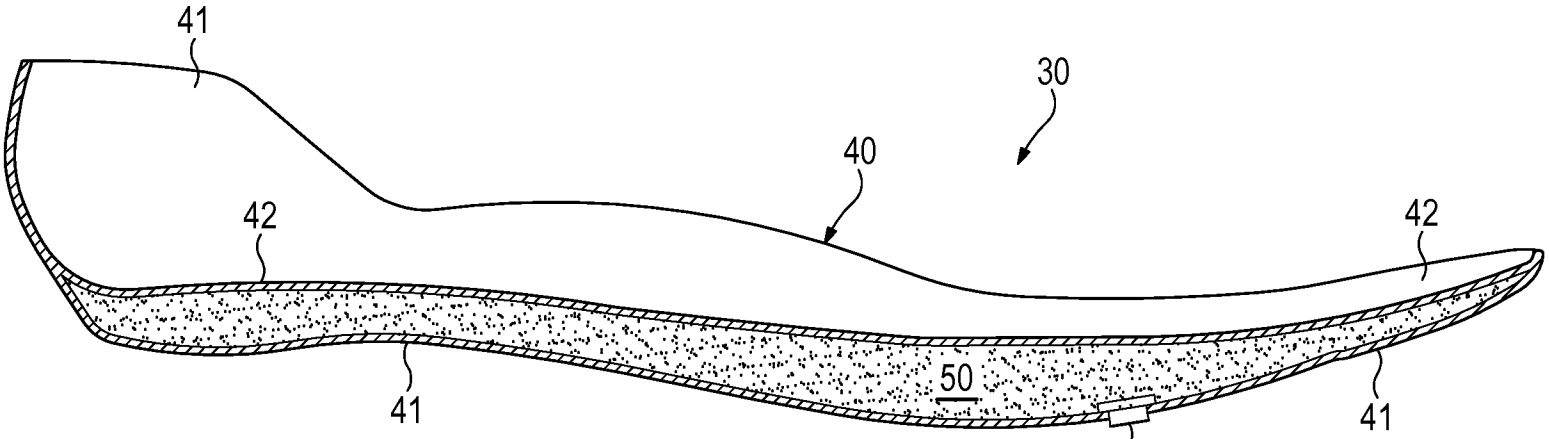

The following discussion and accompanying figures disclose various configurations of composite shell sole structures for articles of footwear. Concepts related to the composite shell sole structures are disclosed with reference to footwear styles that are suitable for cycling and sprinting. Composite shell sole structures are not limited to footwear designed for cycling and sprinting, however, and may be utilized with a wide range of footwear styles, including ski and snowboard boots, motorcycle boots, basketball shoes, cross-training shoes, football shoes, running shoes, soccer shoes, tennis shoes, and walking shoes, for example. Aspects of the composite shell sole structures may also be utilized with footwear styles that are generally considered to be non-athletic, including dress shoes, loafers, sandals, and boots. The concepts disclosed herein may, therefore, apply to a wide variety of footwear styles, in addition to the specific styles discussed in the following material and depicted in the accompanying figures.

General Footwear Structure

An article of footwear 10 having the general configuration of a cycling shoe is depicted in FIGS. 1-3B as including an upper 20 and a sole structure 30. For reference purposes, footwear 10 may be divided into three general regions: a forefoot region 11, a midfoot region 12, and a heel region 13. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textiles, foam, leather, synthetic leather) that are stitched or adhesively bonded together to form a structure with an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a plurality of straps 22 that are utilized in a conventional manner to modify the dimensions of the interior void, thereby securing the foot within the interior void and facilitating entry and removal of the foot from the interior void. Straps 22 are secured to medial side 15 and extend over to lateral side 14, where straps 22 are secured by a fastener (e.g. buttons, snaps, magnets, hook and loop material). As an alternative, a conventional lacing system may be utilized in place of straps 22. Additionally, a sockliner 23 may be located within a lower portion of the void in upper 20 and positioned to contact a plantar (i.e., lower) surface of the foot to enhance the comfort of footwear 10. Given that various aspects of the present discussion primarily relate to sole structure 30, upper 20 may exhibit the general configuration discussed above or the general configuration of practically any other conventional or non-conventional upper. Accordingly, the structure of upper 20 may vary significantly.

Sole structure 30 is secured to upper 20 and has a configuration that extends between upper 20 and the ground. As discussed in greater detail below, sole structure 30 has a configuration of a composite shell (e.g., a fiber-reinforced polymer) that encloses a polymer foam core. This configuration imparts relatively high stiffness and durability to sole structure 30, while having a relatively minimal mass. As noted above, footwear 10 has the general configuration of a cycling shoe. During cycling, a foot of a rider exerts a force (e.g., presses downward) upon a bicycle pedal in order to propel the bicycle forward. The relatively high stiffness of sole structure 30 ensures that forces are efficiently transferred from the rider to the pedal, thereby maximizing the energy utilized to propel the bicycle and the rider forward. Furthermore, the durability and relatively minimal mass of sole structure 30 further enhances the efficient transfer of energy from the rider to the pedal.

Sole Structure Configuration

Sole structure 30 is depicted individually in FIGS. 4-9C as including a shell 40 and a core 50. Whereas shell 40 forms an exterior of sole structure 30, core 50 is located within sole structure 30. More particularly, shell 40 is formed from a composite material that defines a cavity within sole structure 30, and core 50 is formed from a polymer foam material that is enclosed within and substantially fills the cavity. In addition to shell 40 and core 50, sole structure 30 includes mounting hardware 31 in forefoot region 11, which may be utilized to mount a cleat that interfaces with the pedal and secures footwear 10 to the pedal. Depending upon the intended purpose for footwear 10, mounting hardware 31 may have a different location, may be absent, or may have a different form for attaching other devices to footwear 10.

Shell 40 includes a ground portion 41 and a footbed portion 42. Ground portion 41 has a convex outer surface and an opposite concave inner surface, thereby imparting a rounded aspect to shell 40. In this configuration, at least a portion of the outer surface forms a portion of an exterior surface of sole structure 30. More particularly, ground portion 41 forms a lower, ground-engaging surface and side surfaces of sole structure 30. In heel region 13, ground portion 41 extends upward to form a heel counter, which effectively interfaces or joins with upper 20 to reduce movement of a heel within footwear 10.

Footbed portion 42 has an upper surface that faces upper 20 and an opposite lower surface. The upper surface of footbed portion 42 has a contoured configuration that may correspond with contours of a lower area of a foot. More particularly, footbed portion 42 may be contoured such that the upper surface defines a depression in heel region 13 and a protruding area (i.e., arch support) in midfoot region 12 and on medial side 15. The lower surface of footbed portion 42 lays against core 50. A periphery of footbed portion 42 is secured to ground portion 41 to define the cavity within shell 40, which is located between the concave inner surface of ground portion 41 and the lower surface of footbed portion 42 and receives core 50. More particularly, the periphery of footbed portion 42 extends between opposite sides and is secured to an upper area of the inner surface of ground portion 41.

A variety of materials may be utilized for shell 40, including molded polymers, machined or cast metals, or composite materials that are generally formed from two or more constituent materials. An example of a composite material that is suitable for shell 40 is a polymer matrix having fiber reinforcement, in which a polymer material (i.e., the polymer matrix) encloses, extends around, or otherwise includes a plurality of fibers (i.e., the fiber reinforcement). Suitable polymer matrix materials for shell 40 include, for example, epoxy, polyurethane, polyester, polypropylene, and vinyl ester. Suitable fiber reinforcement materials for shell 40 include, for example, various filaments, fibers, yarns, and textiles that are formed from rayon, nylon, polyester, polyacrylic, silk, glass, boron, silicon carbide, carbon, aramids (e.g., para-aramid fibers and meta-aramid fibers), ultra high molecular weight polyethylene, and liquid crystal polymer.

While any of these fiber reinforcement materials may be utilized for shell 40, an advantage may be gained by utilizing various engineering fibers (i.e., fibers formed from carbon, aramid, ultra high molecular weight polyethylene, and liquid crystal polymer). The engineering fibers each have a tensile strength greater than 0.60 gigapascals, a tensile modulus greater than 50 gigapascals, and a density less than 2.0 grams per centimeter cubed. In addition to providing a relatively high stretch-resistance, the engineering fibers impart a relatively high strength to mass ratio. More particularly, the engineering fibers impart a relatively low mass per unit length, while providing a relatively high tensile strength, thereby imparting stretch-resistance, stiffness, and relatively minimal mass. As discussed above, sole structure 30 has a relatively high stiffness to ensure that forces are efficiently transferred from the rider to the pedal, thereby maximizing the energy utilized to propel the bicycle forward. Furthermore, the durability and relatively minimal mass of sole structure 30 further enhances the efficient transfer of energy from the rider to the pedal. This combination of properties may be gained from composite materials that include the engineering fibers.

Although a variety of materials may be utilized for the polymer matrix and fiber reinforcement, a more specific example of suitable materials includes (a) a polymer matrix formed from an epoxy resin, such as SYSTEM 2000 EPOXY RESIN and 2020 EPOXY HARDENER, each manufactured by FIBER GLAST DEVELOPMENTS CORPORATION of Brookville, Ohio, USA and (b) fiber reinforcement having the configuration of a textile or cloth formed from carbon fibers and having a 2×2 twill weave and a mass of approximately 193 grams per square meter (51.3 ounces per square foot). Whereas three layers of the carbon fiber textile may be utilized for ground portion 41, two layers of the carbon fiber textile may be utilized for footbed portion 42. That is, a greater number of textile layers may be incorporated into ground portion 41 than footbed portion 42. In some configurations, a single layer of unidirectional carbon fiber may be incorporated into ground portion 41 (e.g., between two other layers of textile) in the area of mounting hardware 31 to add stiffness and strength where a cleat or other device may be secured to footwear 10.

Core 50 is located within and substantially fills the cavity within shell 40. In this configuration, core 50 is located between the concave inner surface of ground portion 41 and the lower surface of footbed portion 42. A variety of materials may be utilized for core 50, including polymer foams (e.g., polyurethane, polyethylene, urethane), non-foamed polymers, cellular metal materials, and wood, for example. Although a variety of materials may be utilized for core 50, a more specific example of a suitable material is a liquid two-part expanding polyurethane foam, such as TC-300 RIGID POLYURETHANE FOAM with a density of approximately 96.2 kilograms per cubic meter (6.0 pounds per cubic foot), which is manufactured by BJB ENTERPRISES, INC. of Tustin, Calif., USA.

The configuration discussed above imparts various features to footwear 10. First, a relatively small number of components are utilized to form sole structure 30, such that each of ground portion 41, footbed portion 42, the cavity between portions 41 and 42, and core 50 extend through a majority of a length and a width of sole structure 30. Second, a relatively large percentage (i.e., at least ninety percent) of a mass of sole structure 30 is formed from shell 40, core 50, and mounting hardware 31. An advantage to this is that each of the components contributing to the overall mass of sole structure 30 have relatively little mass, which imparts a relatively lightweight configuration to footwear 10. Third, at least one portion of the sole structure has a vertical thickness consisting of two layers from shell 40 (i.e., ground portion 41 and footbed portion 42) and core 50. Referring to the cross-sections of FIGS. 3A and 3B, for example, the vertical thickness of at least one area (e.g., a central area) only includes core 50 and the two layers from shell 40. Similarly, an advantage to this is that each of these components that form the vertical thickness of sole structure 30 have relatively little mass, which imparts a relatively lightweight configuration to footwear 10. Moreover, separating the layers of composite material by a layer of foam increases the bending force necessary to flex or otherwise deflect sole structure 30, thereby contributing to the overall stiffness of sole structure 30.

Figure 10A:
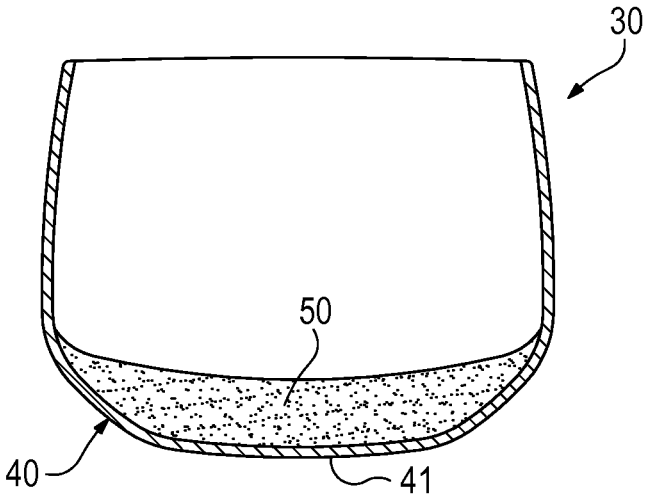
FIGS. 10A-10F are cross-sectional views corresponding with FIG. 9A and depicting further configurations of the sole structure.
Figure 10B:
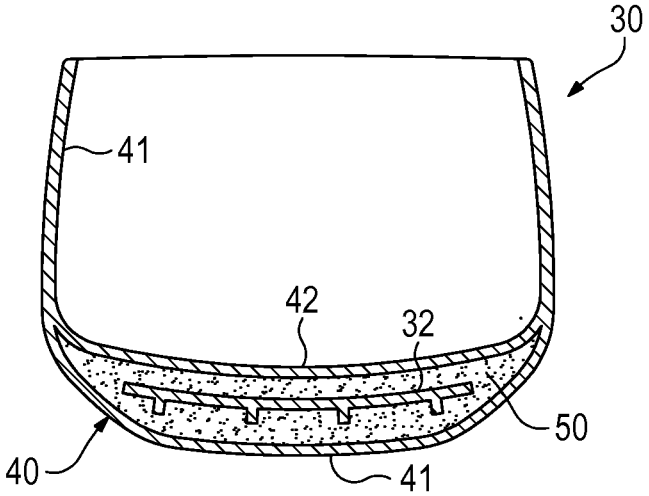
Figure 10C:
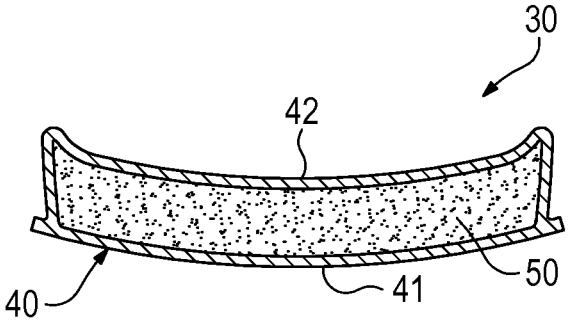
Figure 10D:
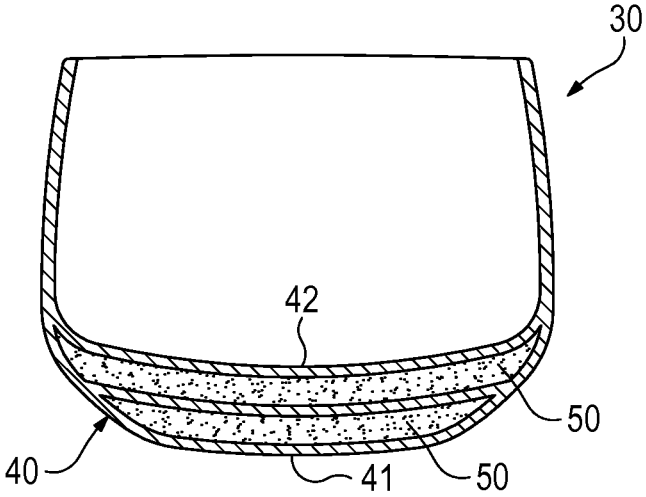
Figure 10E:
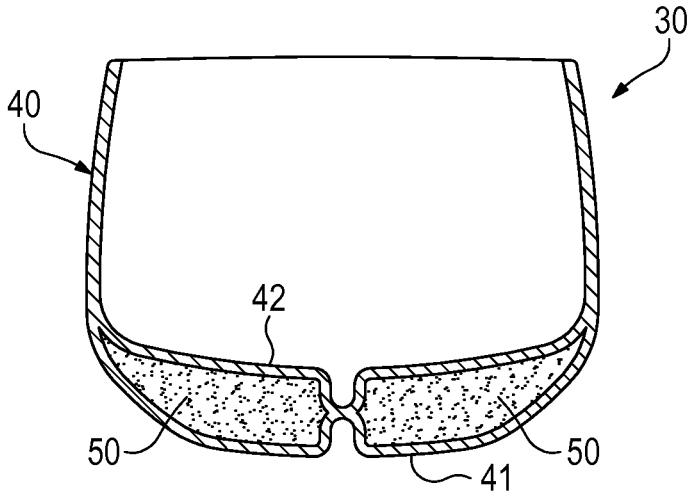
Figure 10F:
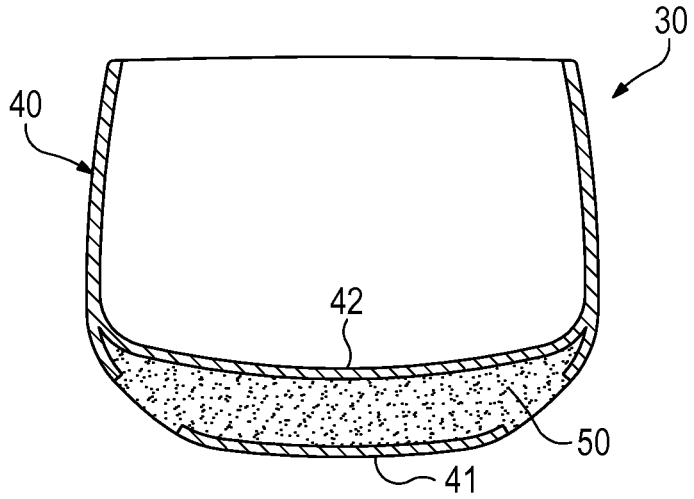
Figure 11A:
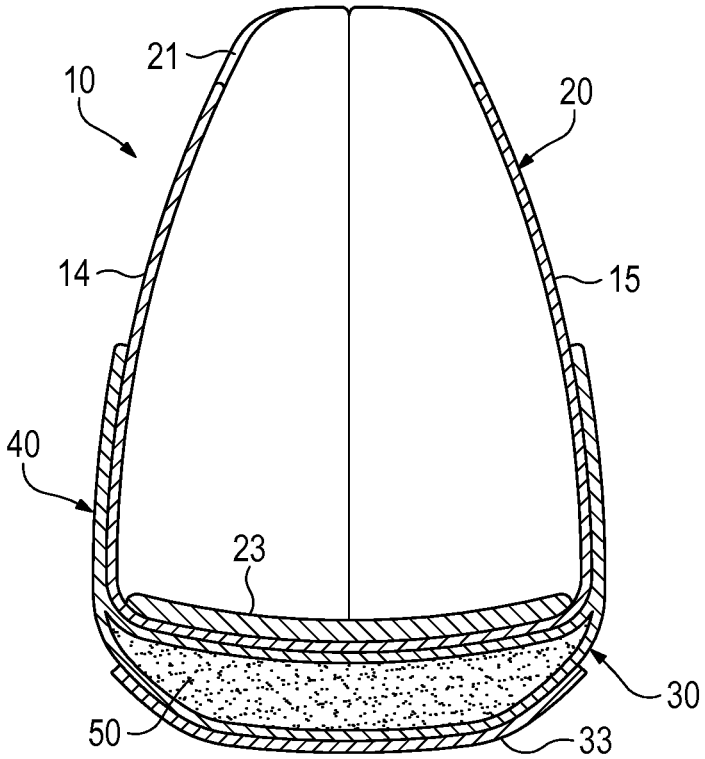
FIGS. 11A-11C are cross-sectional views corresponding with FIG. 3A and depicting further configurations of the article of footwear.
Figure 11B:
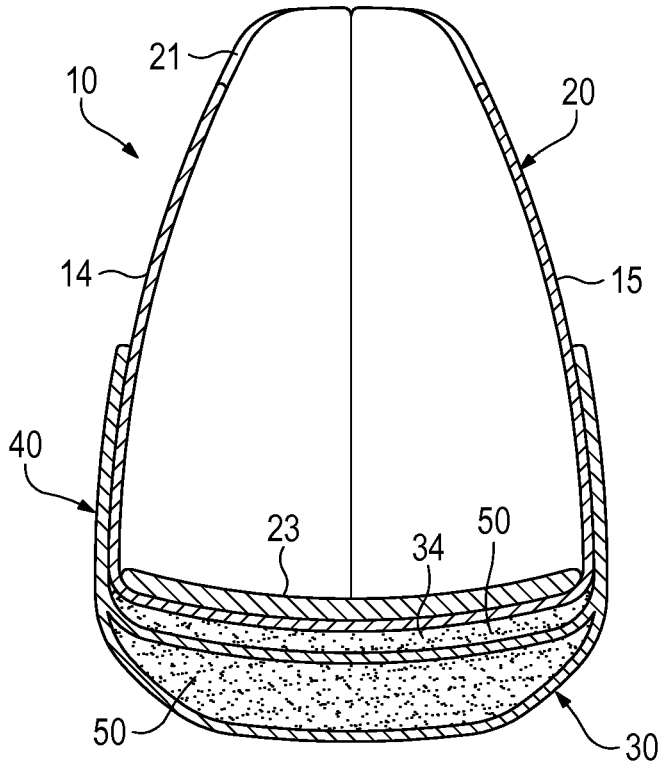
Figure 11C:
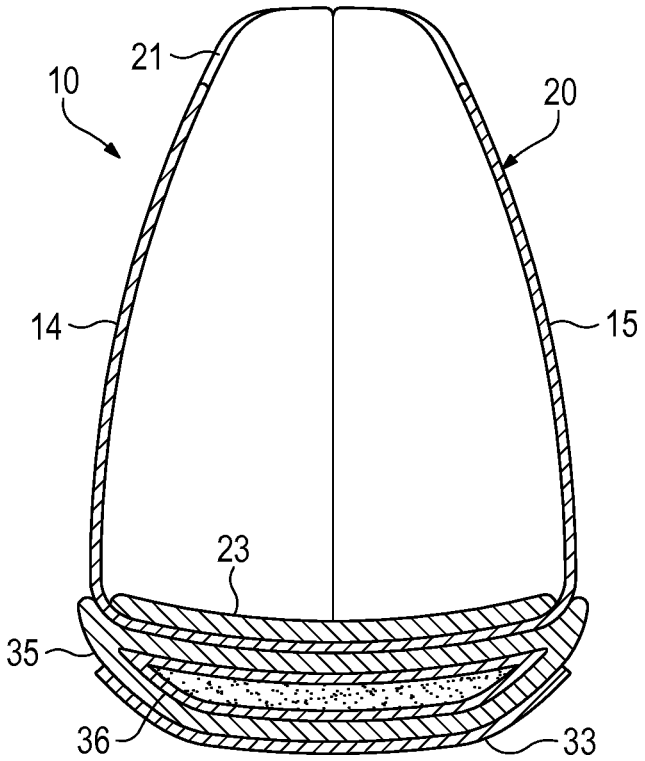

The configuration of sole structure 30 discussed above provides an example of a suitable configuration for footwear 10 and a variety of other styles and types of footwear. Various aspects of sole structure 30 may, however, vary significantly. Referring to FIG. 10A, sole structure 30 is depicted as having a structure wherein footbed portion 42 is absent. In this configuration, upper 20 may be directly-bonded or otherwise secured to core 50. FIG. 10B depicts a configuration wherein a reinforcing member 32 is located within core 50 to, for example, strengthen sole structure 30, impart greater stiffness, or resist torsional forces. Fluid-filled chambers, beams, moderators, or a variety of other elements may also be located within the cavity in shell 40 and within core 50 to enhance the properties of footwear 10. In some configurations, footbed portion 42 may form both the upper surface and side surfaces of sole structure 30 and ground portion 41 may form only the lower surface, as depicted in FIG. 10C. As depicted in FIG. 10D, although shell 40 may define a single cavity for core 50, multiple cavities may also be formed. In another configuration, central areas of portions 41 and 42 may be joined, as depicted in FIG. 10E, which may affect the medial-lateral flexibility of sole structure 30. Referring to FIG. 10F, some configurations of shell 40 may form various apertures that expose portions of core 50. In order to enhance the traction properties of footwear 10, an outsole 33 may be secured to the lower surface of sole structure 30, as depicted in FIG. 11A. A supplemental layer 34 (e.g., a foam layer that is a part of upper 20 or sole structure 30) may also be located to extend adjacent to footbed portion 42 in order to enhance the overall comfort of footwear 10, as depicted in FIG. 11B. Furthermore, some configurations of footwear 10 may incorporate a foam element 35 that forms a majority of a volume of sole structure 30, as depicted in FIG. 11C. In these configurations, a shell/core element 36, which is similar to shell 40 and core 50, may be embedded within foam element 35. Accordingly, the overall configuration of sole structure 30, when incorporating a composite shell structure, may vary significantly.

Based upon the above discussion, sole structure 30 includes both shell 40 and core 50. When utilized for cycling or other activities, the configuration and materials of shell 40 and core 50 impart a relatively high stiffness to sole structure 30. Furthermore, the configuration and materials of shell 40 and core 50 impart durability and a relatively minimal mass to sole structure 30.

Manufacturing Process

Figure 12:
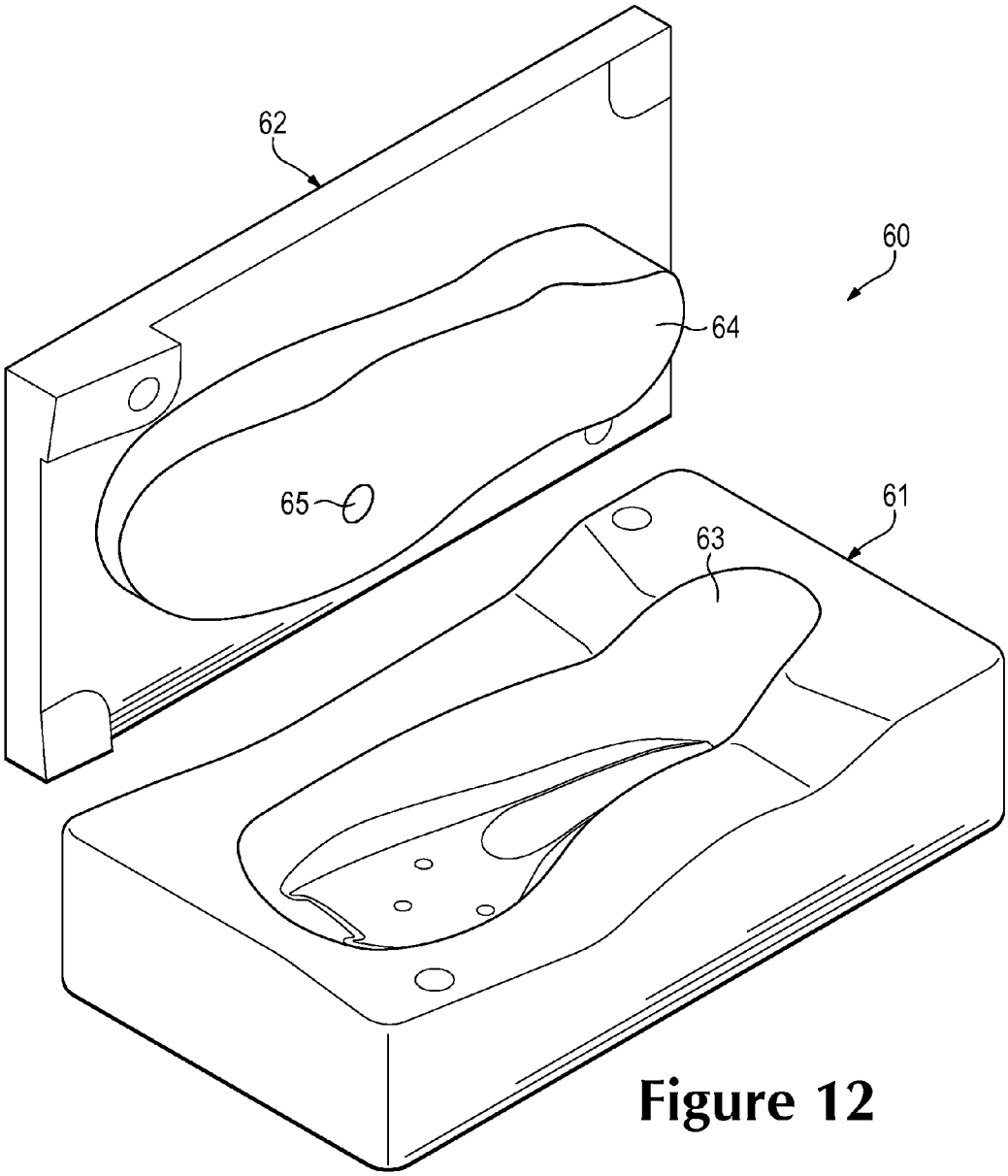
FIG. 12 is a perspective view of a mold.

The manufacturing process for sole structure 30 utilizes a mold 60 having a first mold portion 61 and a second mold portion 62, as depicted in FIG. 12. As oriented in the various figures, first mold portion 61 is generally located below second mold portion 62, but the relative positions of mold portions 61 and 62 may vary. Mold portions 61 and 62 cooperatively define an internal cavity exhibiting the general shape of sole structure 30. More particularly, first mold portion 61 defines an indented or concave surface 63 with the general shape of an exterior of ground portion 41, and second mold portion 62 defines a protruding or convex surface 64 with the general contours of an upper surface of core 50 (i.e., the surface of core 50 that lays adjacent to footbed portion 42 and imparts shape to footbed portion 42). In other configurations, mold portions 61 and 62 may cooperatively define two internal cavities, one having the configuration of sole structure 30, which is suitable for footwear 10 when configured for the right foot of a wearer (e.g., the rider), and the other having the configuration of a mirror image of sole structure 30, which is suitable for footwear 10 when configured for the left foot of the wearer.

The manner in which mold 60 is utilized to form sole structure 30 will now be discussed in greater detail. Initially, surface 63 of first mold portion 61 may be treated with a release agent, clear coat material, or other material that assists with the production or final aesthetics of sole structure 30, particularly the exterior of shell 40. As an example, a clear polyester gel coat, such as 173 CLEAR GEL COAT thinned fifty percent with DURATECH 904-001 CLEAR HI GLOSS ADDITIVE, both available from FIBER GLAST DEVELOPMENTS CORPORATION, may be utilized improve or otherwise enhance the finished cosmetics of shell 40.

Figure 13A:
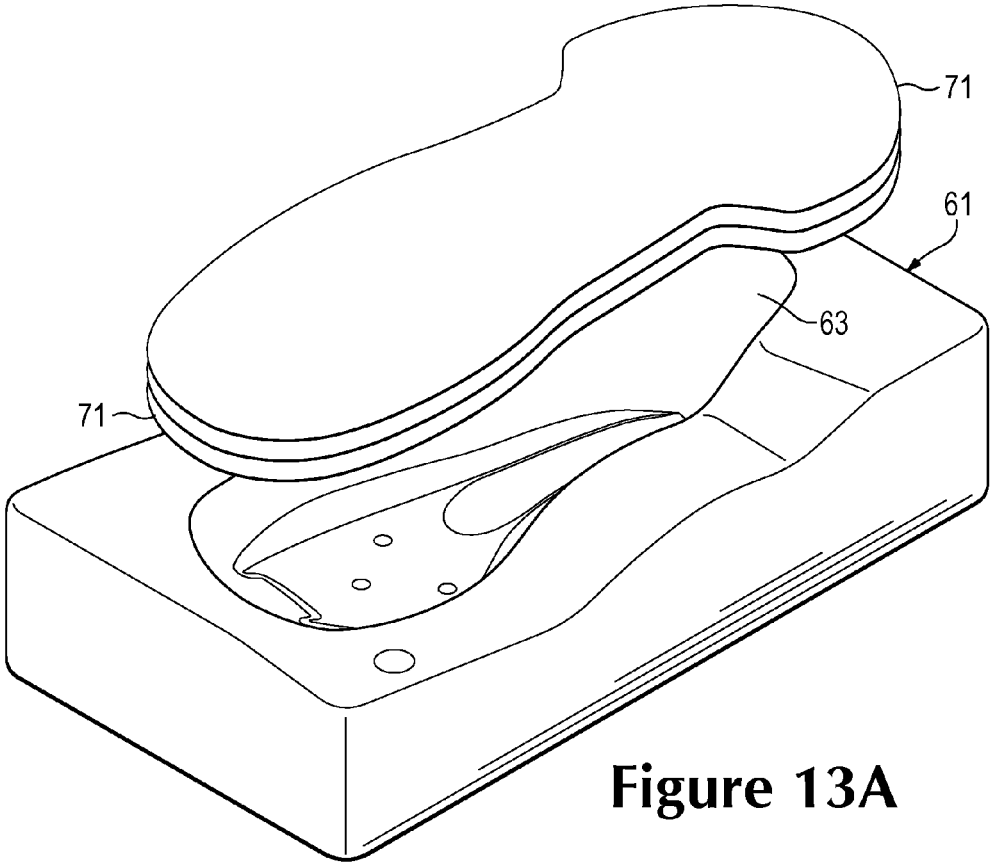
FIGS. 13A-13L are schematic perspective views of a manufacturing process for the sole structure.
Figure 13B:
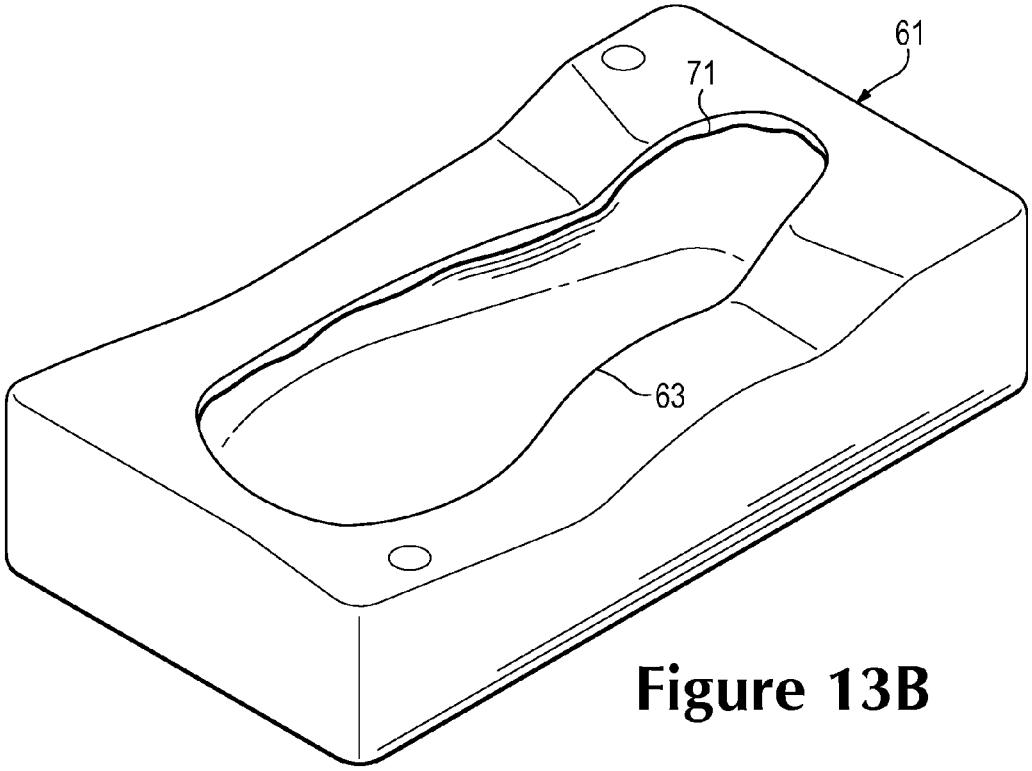
Figure 14A:
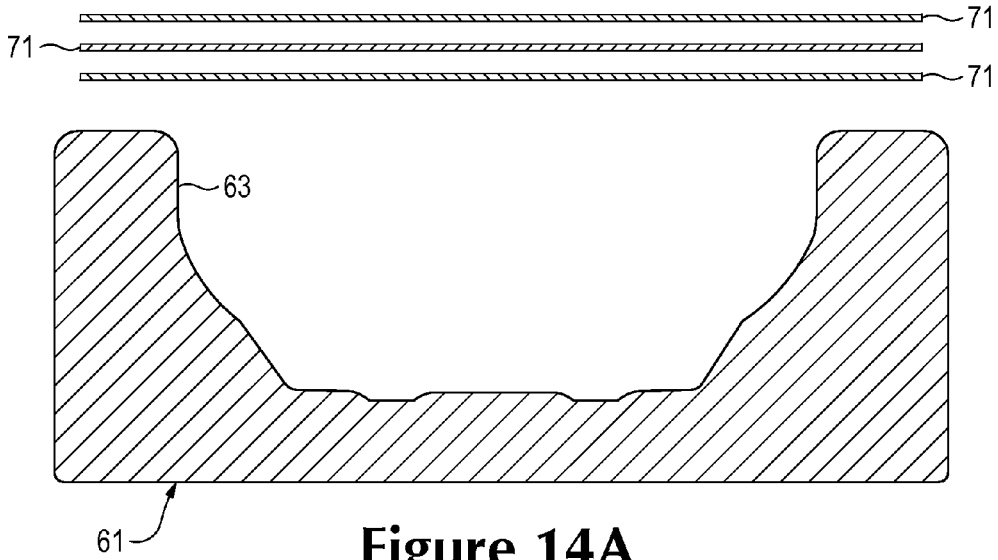
FIGS. 14A-14K are schematic cross-sectional views of the manufacturing process, as respectively defined by section lines 14A-14K in FIGS. 13A-13K.
Figure 14B:
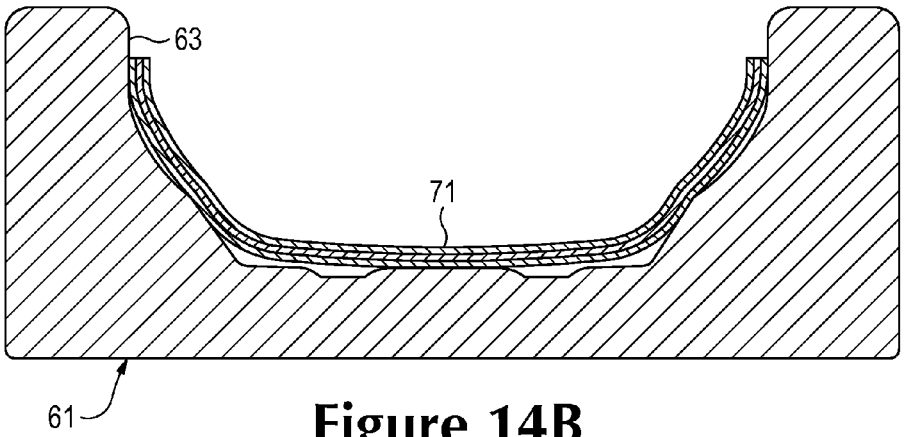

Once mold 60 is properly prepared, various layers 71 of fiber reinforcement may be prepared, as depicted in FIGS. 13A and 14A. These layers 71 will be utilized to form ground portion 41 and are cut to have a general shape that will accommodate the formation of ground portion 41. Although three layers 71 are depicted, any number of layers 71 may be utilized. As discussed above, the fiber reinforcement may have, as an example, the configuration of a textile or cloth formed from carbon fibers, but a variety of other materials or textile weaves may be utilized for layers 71. In some manufacturing process, a single layer of unidirectional carbon fiber may also be located between two of layers 71 to add stiffness to the area where mounting hardware 31 is located later in the manufacture of sole structure 30. Layers 71 are then laid within first mold portion 61 and against surface 63 with a polymer resin, as depicted in FIGS. 13B and 14B. More particularly, layers 71 are brushed, sprayed, dipped, or impregnated with the polymer resin, which becomes the polymer matrix of ground portion 41. As discussed above, the polymer matrix may be formed from an epoxy resin, but a variety of resin formulations may be utilized.

Figure 13C:
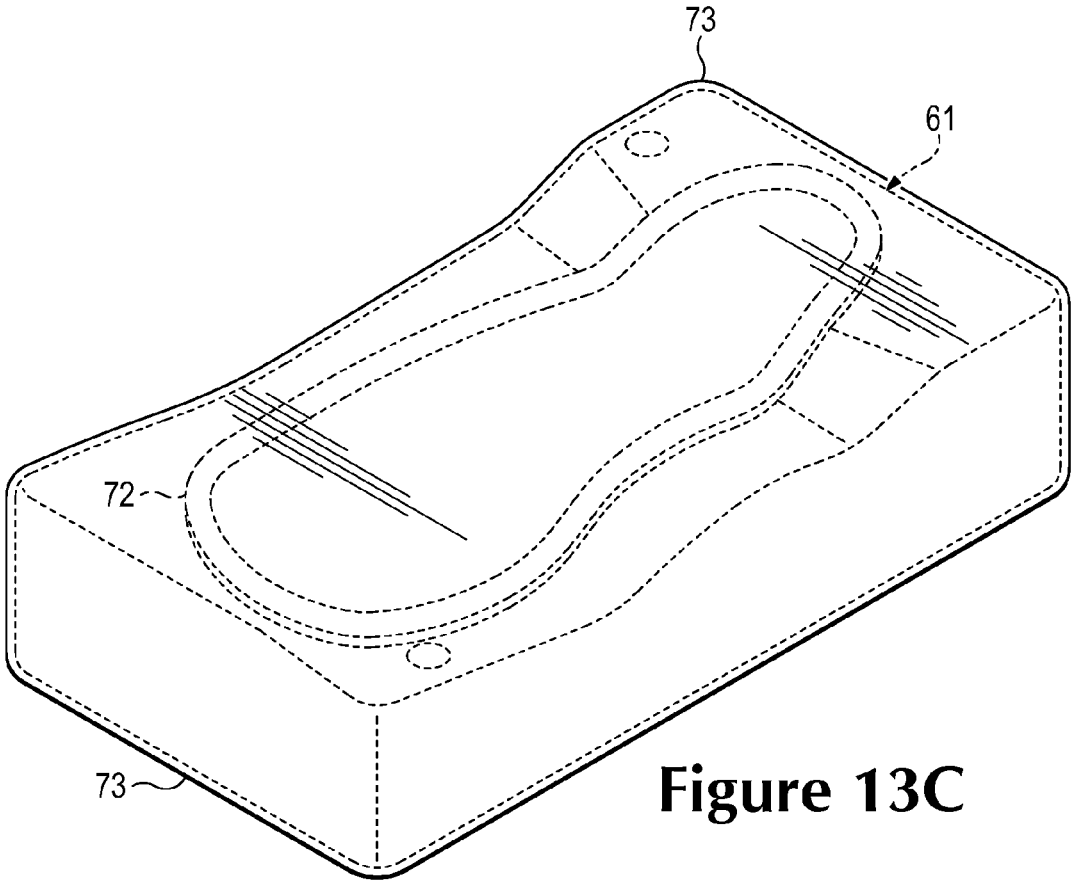
Figure 14C:
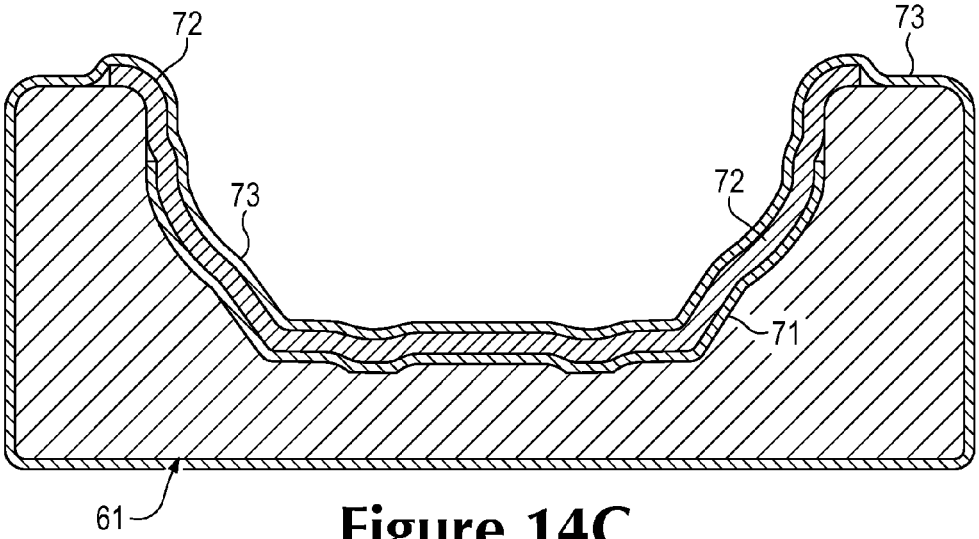

A vacuum system may be employed to ensure that layers 71 and the polymer resin conform to the contours of surface 63 and minimize the presence of air pockets. Referring to FIGS. 13C and 14C, the vacuum system includes a breather material 72 and a vacuum bag 73. Breather material 72 is positioned adjacent to layers 71 and surface 63, and vacuum bag 73 extends entirely around the combination of first mold portion 61, layers 71, the polymer resin, and breather material 72. Additionally, a release material may be positioned between layers 71 and breather material 72 in order to (a) impart a bondable surface and (b) prevent bonding of layers 71 with breather material 72. Upon the application of a vacuum, air from within vacuum bag is evacuated. Given that breather material 72 has a porous configuration, the air may freely pass to an exit of vacuum bag 73. Moreover, the differential in pressure induces vacuum bag 73 to press layers 71 and the polymer resin against surface 63. This configuration is held until the polymer resin sets, which may be in a range of twenty minutes to more than one hour. A variety of other conventional systems may be utilized in place of the vacuum system, including pressure bag molding, autoclave molding, and resin transfer molding.

Figure 13D:
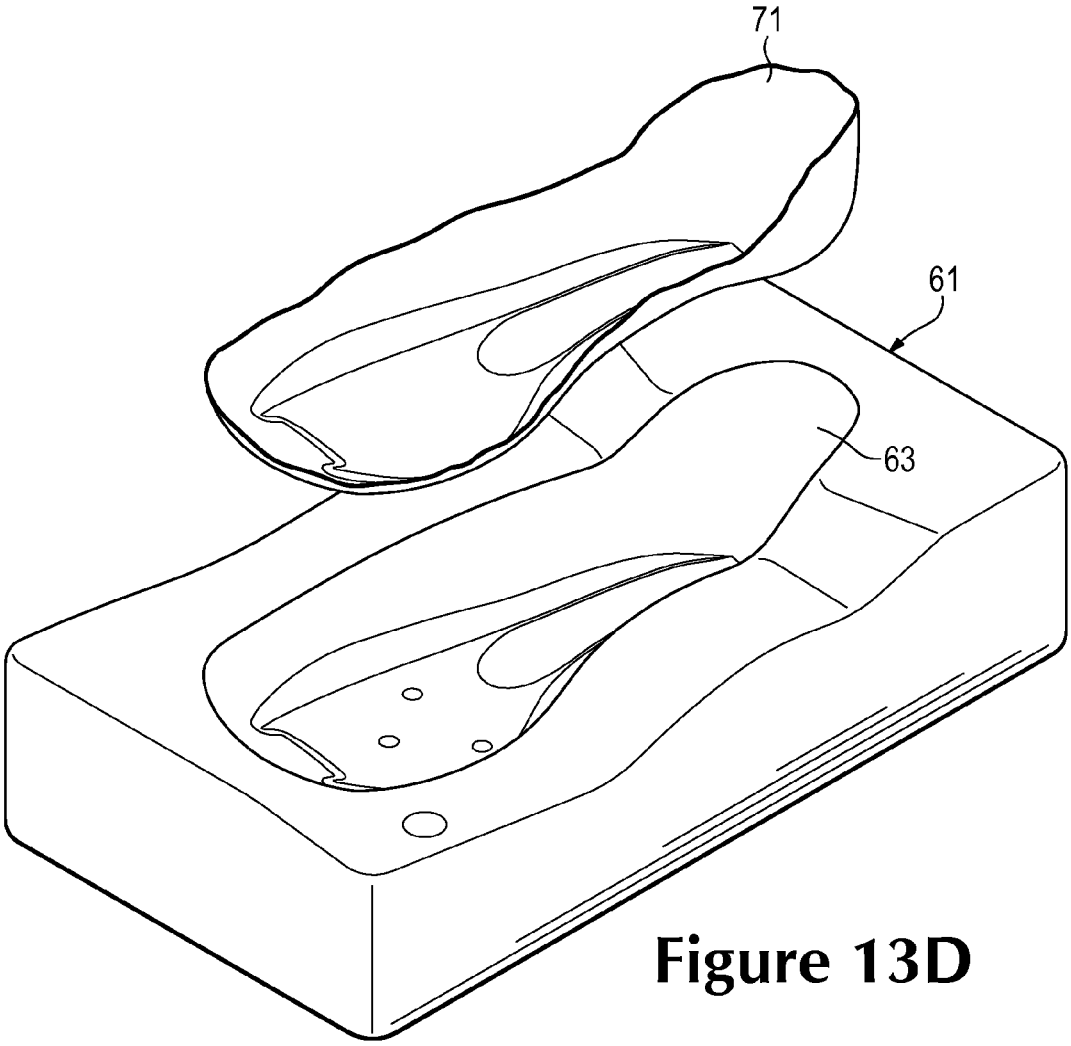
Figure 14D:
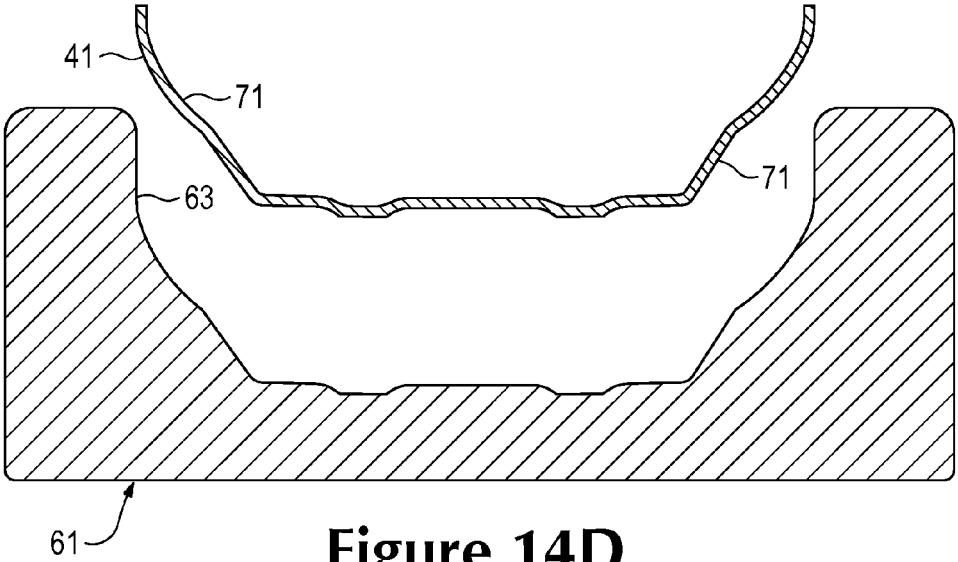

Once the polymer resin is set, vacuum bag 73 and breather material 72 may be removed. Additionally, a composite structure formed from layers 71 and the polymer matrix, which effectively forms ground portion 41, may be removed from first mold portion 61, as depicted in FIGS. 13D and 14D. Ground portion 41 is then sanded or smoothed to remove irregular areas, and excess material is trimmed. Holes are also drilled to accommodate the installation of mounting hardware 31.

Figure 13E:
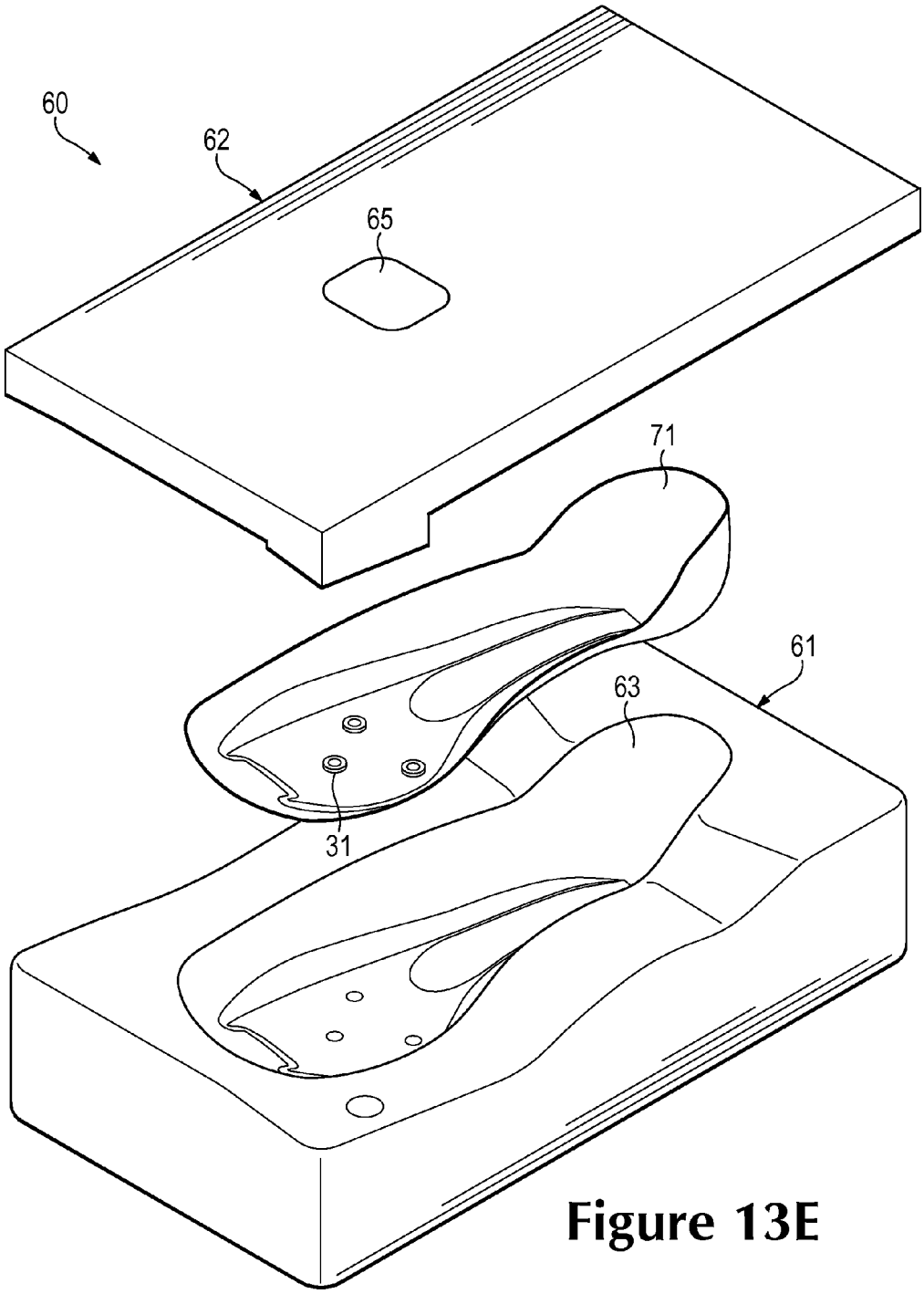
Figure 13F:
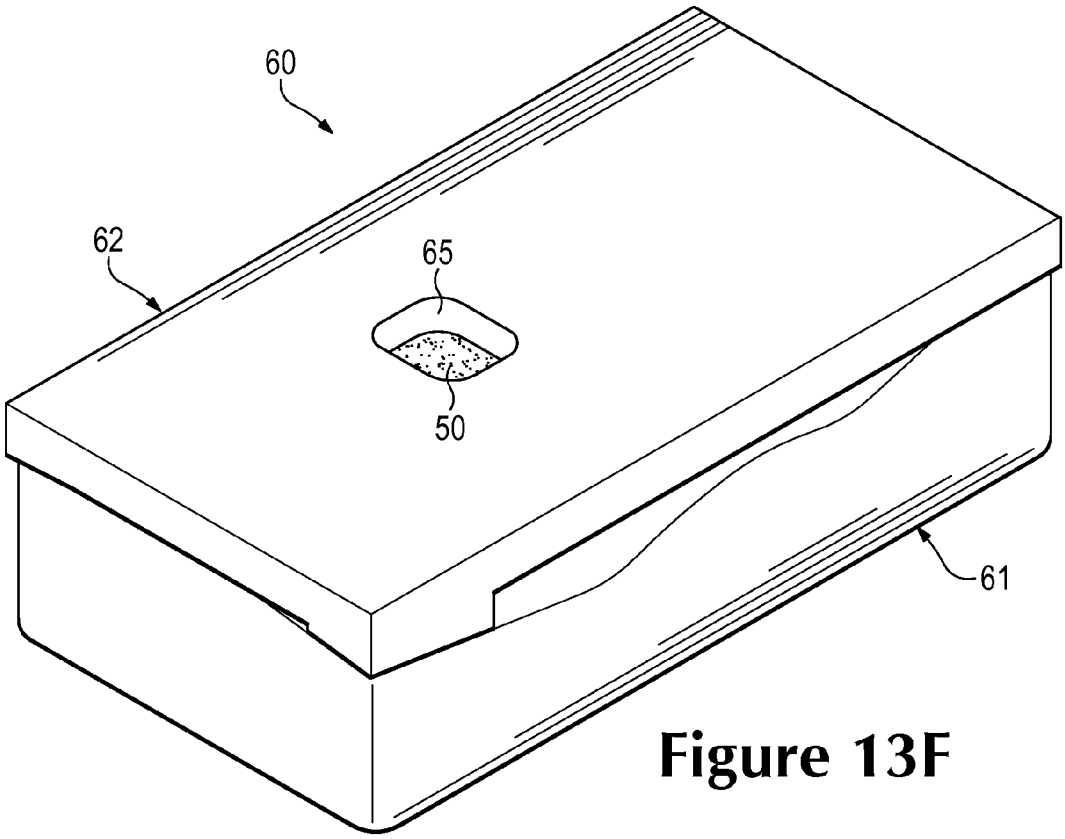
Figure 13G:
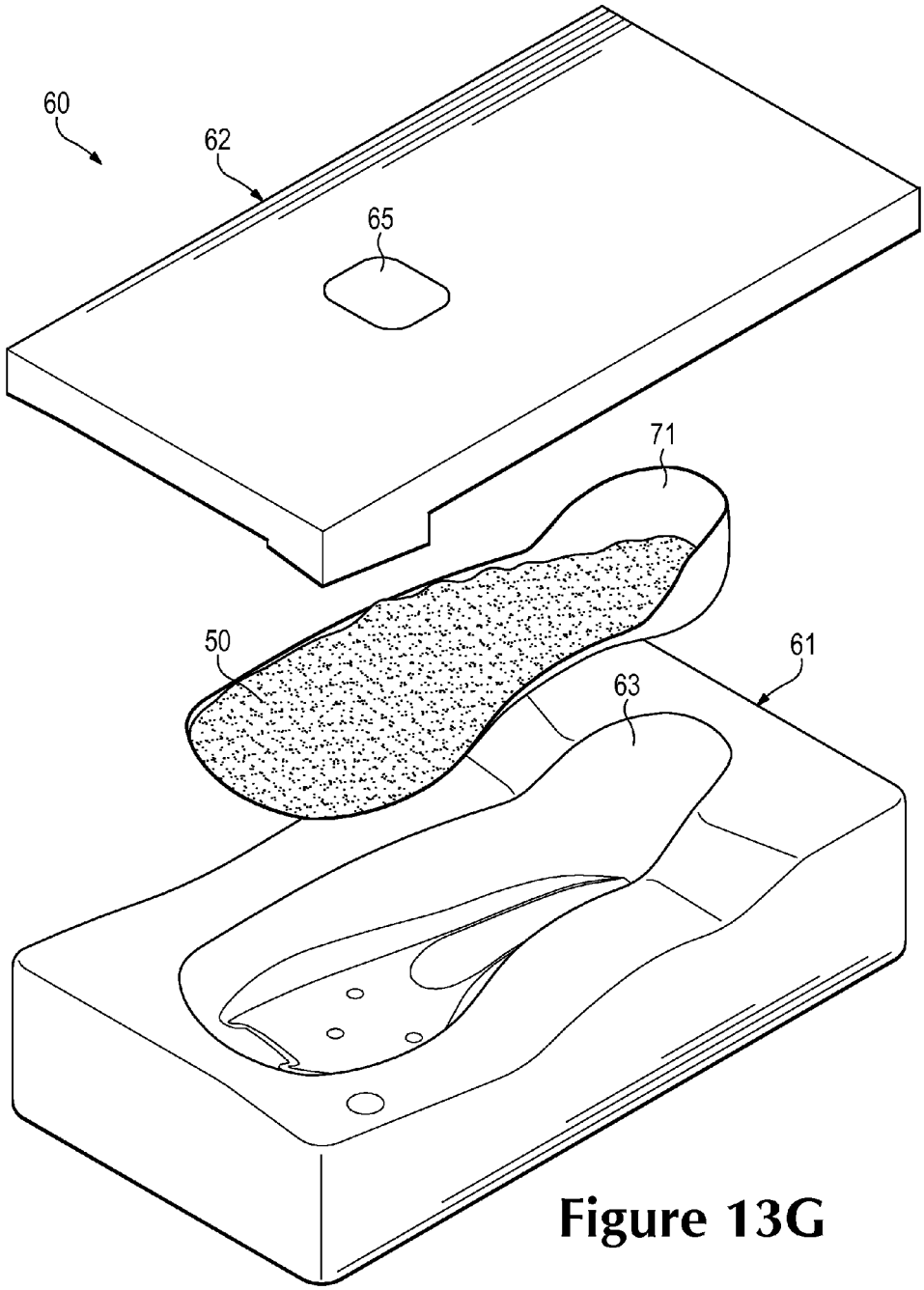
Figure 14E:
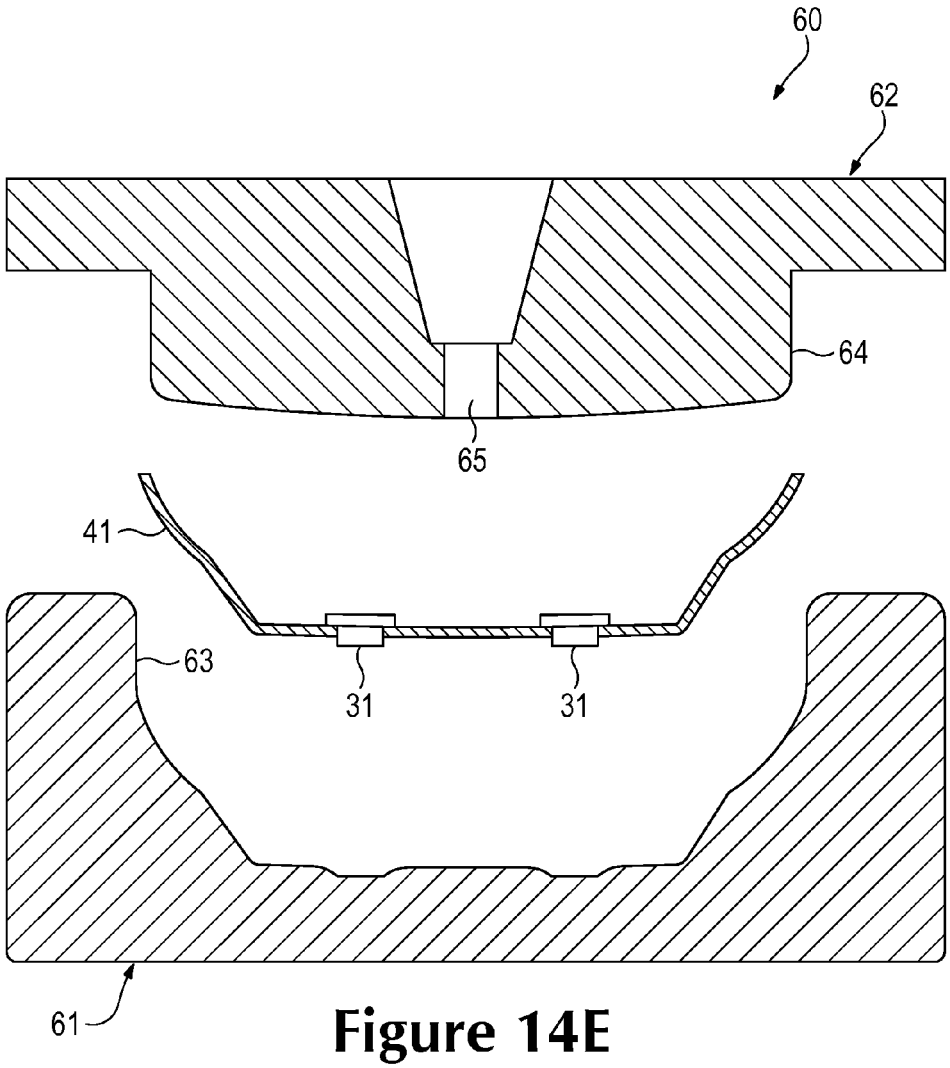
Figure 14F:
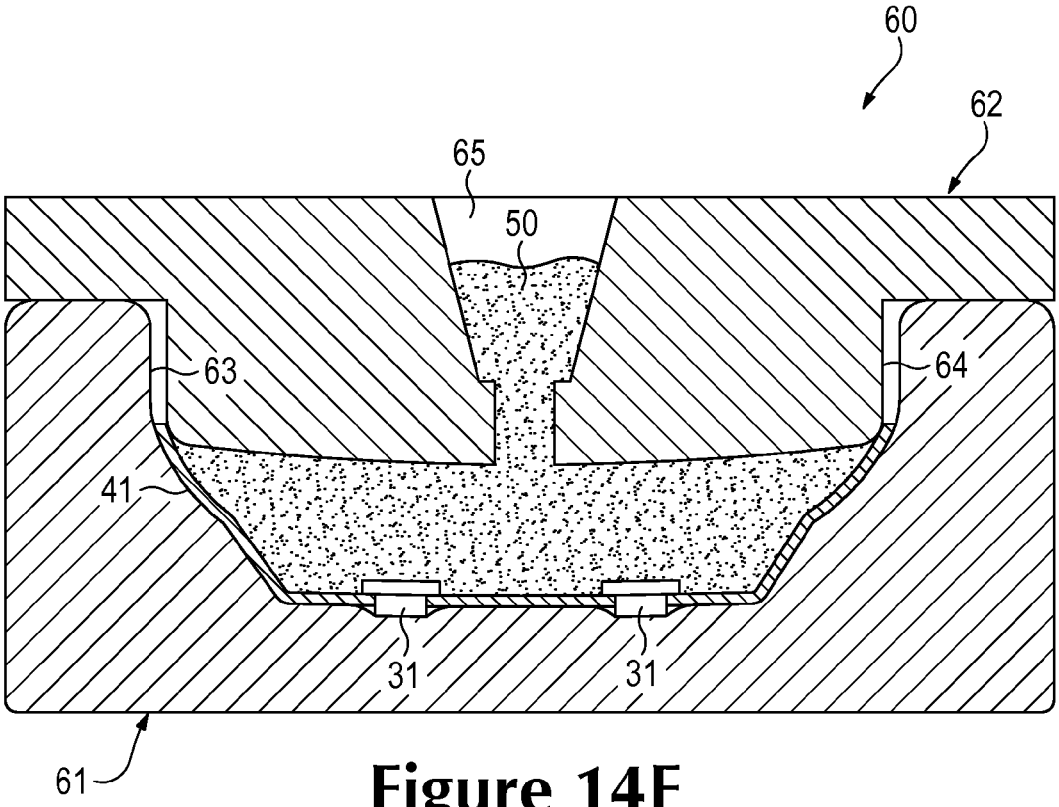
Figure 14G:
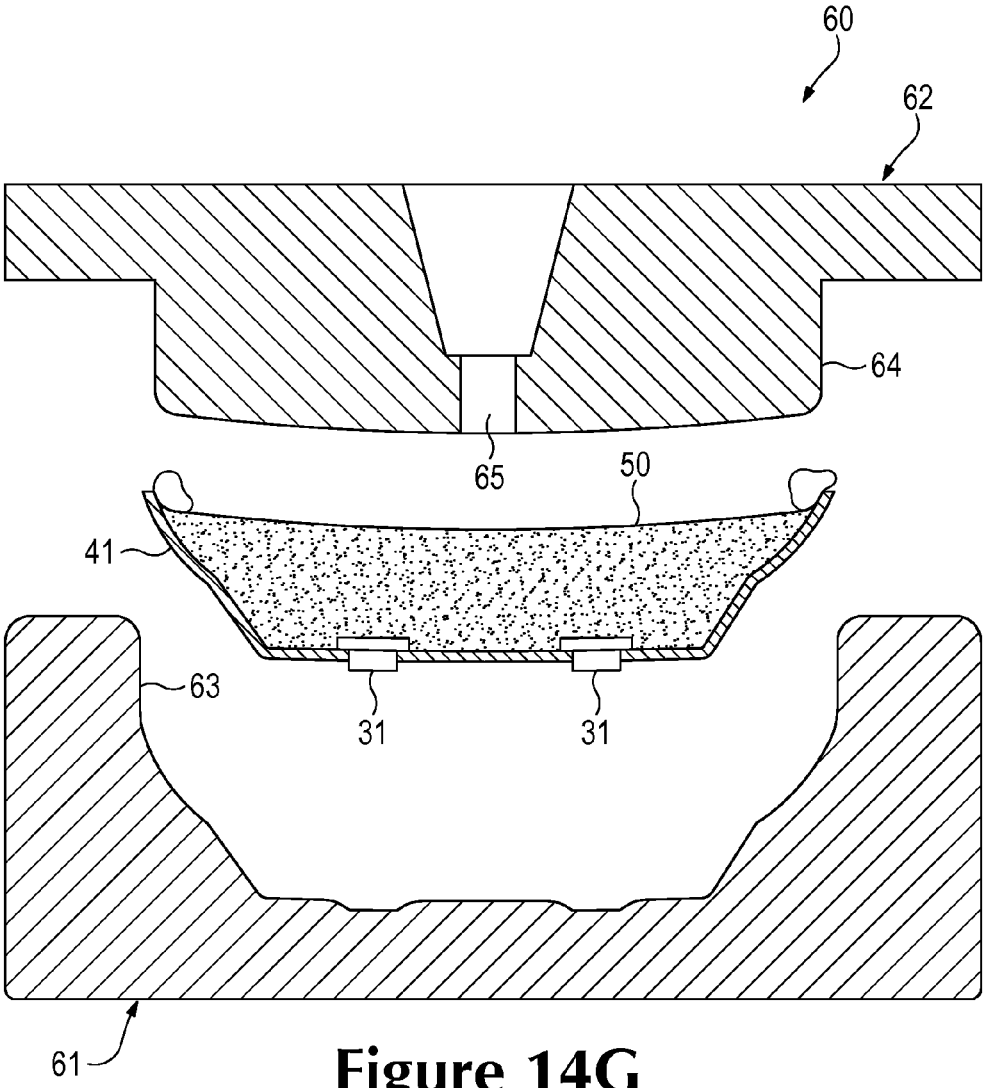

At this stage of the manufacturing process, ground portion 41 is formed and mounting hardware 31 is installed. Ground portion 41 is then positioned between mold portions 61 and 62, as depicted in FIGS. 13E and 14E. Mold portions 61 and 62 then close, as depicted in FIGS. 13F and 14F such that ground portion 41 is located between surfaces 53 and 54. Given that ground portion 41 was formed against surface 63, an exterior of ground portion 41 lays against surface 63. Surface 64, however, lays against some areas of ground portion 41 and is separated from central areas of ground portion 41. As a result, mold 60 forms a space between surface 64 and the central areas of ground portion 41, in which a polymer foam that forms core 50 is introduced. More particularly, a liquid two-part part expanding polyurethane foam or any of a variety of foam formulations may be poured or injected into mold 60 through a conduit 65 in second mold portion 62. As the polymer foam expands, the foam fills the space between surface 64 and the central areas of ground portion 41, and some of the foam may expand out of mold 60. An upper surface of the polymer foam contacts surface 64 and is effectively molded to the shape of surface 64. Following the formation and shaping of core 50 within the concave area of ground portion 41, this structure is removed from mold 60, as depicted in FIGS. 13G and 14G. Core 50 is then sanded or smoothed to remove irregular areas, and excess polymer foam material is trimmed.

Given that the contours of surface 64 may correspond with the contours of a foot, the formation of core 50 effectively contours sole structure 30 in a manner that is suitable for resting against a lower surface of the foot and supporting the foot. As an example, the contours of surface 64 may impart a depression in heel region 13 and a protruding area (i.e., arch support) in midfoot region 12 and on medial side 15. As another example, the contours of surface 64 may be formed from a casting or impression of a particular individual's foot to impart a custom aspect to footwear 10. That is, custom articles of footwear may be produced by forming surface 64 of second mold portion 62 to have the particular contours of the individual's foot.

Figure 13H:
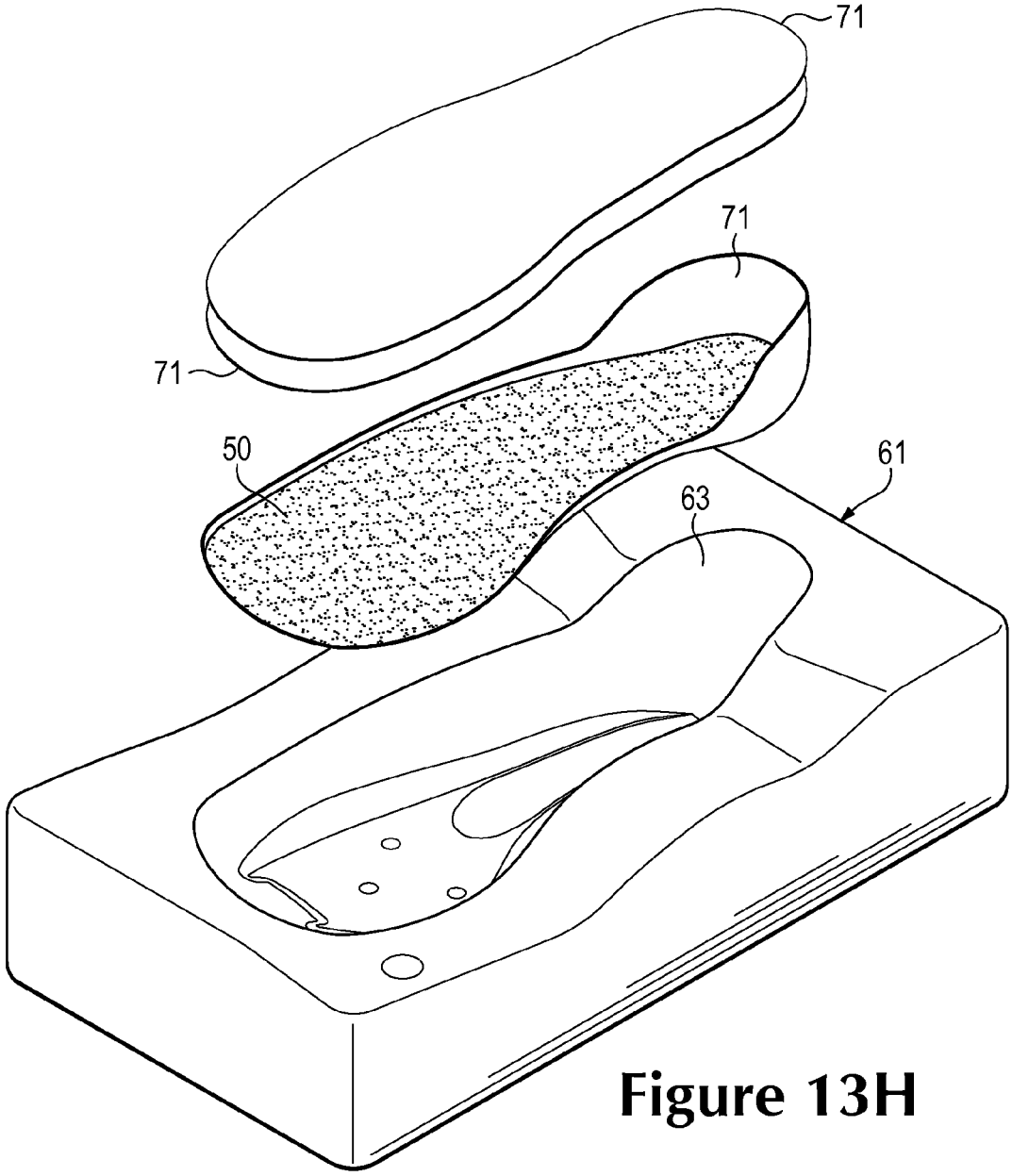
Figure 13I:
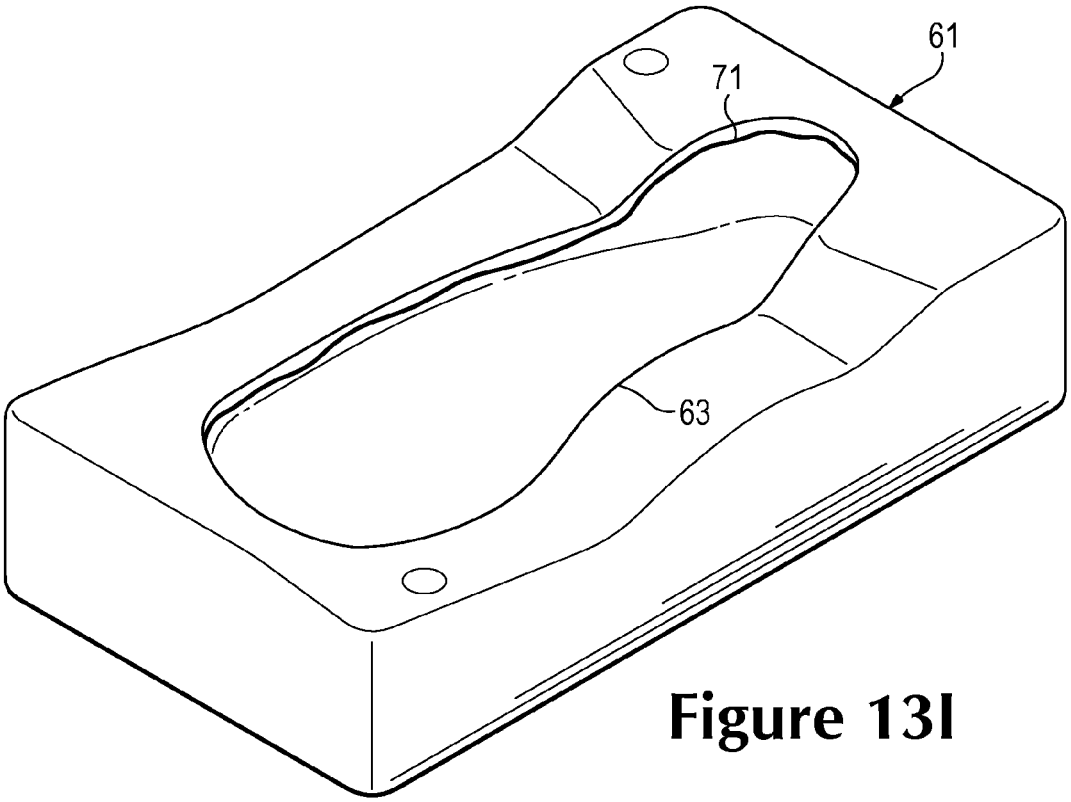
Figure 14H:
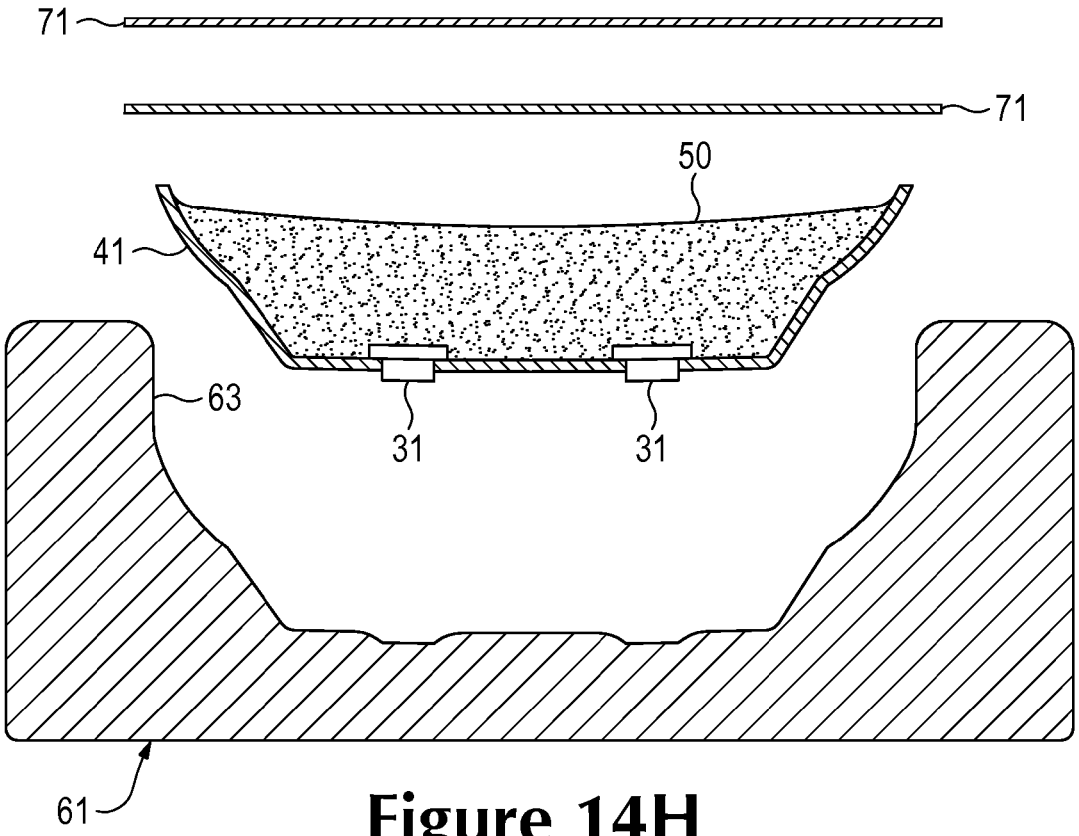
Figure 14I:
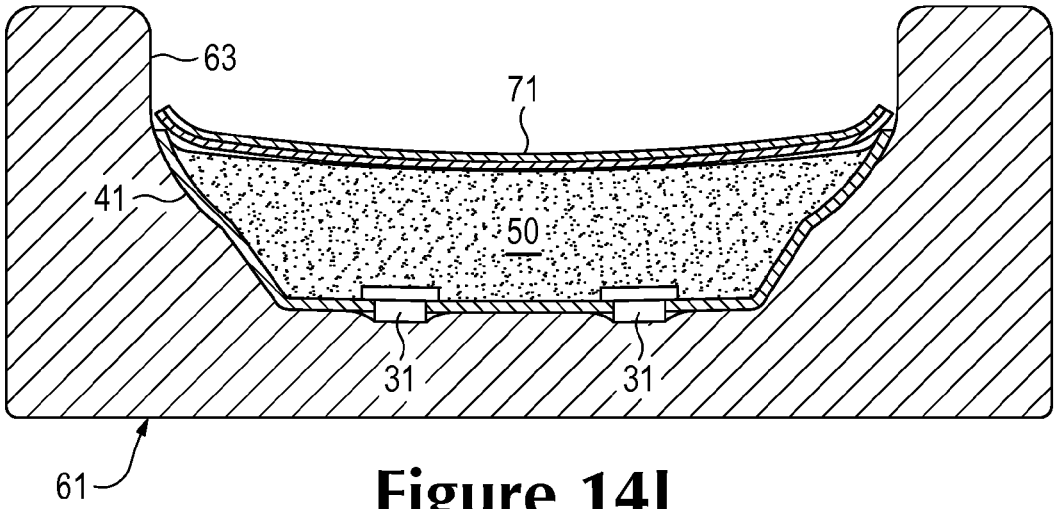

Additional layers 71 of fiber reinforcement are now prepared, as depicted in FIGS. 13H and 14H. These additional layers 71 will be utilized to form footbed portion 42 and are cut to have a general shape that will accommodate the formation of footbed portion 42. Although two layers 71 are depicted, any number of additional layers 71 may be utilized. The combination of ground portion 41 and core 50 is then placed within first mold portion 61, as depicted in FIGS. 13I and 14I, and the additional layers 71 are laid against an upper surface of core 50 with a polymer resin. Edge areas of the additional layers 71 also contact peripheral areas of ground portion 41 (i.e., the concave inner surface). As with the formation of ground portion 41, layers 71 are brushed, sprayed, dipped, or impregnated with the polymer resin, which becomes the polymer matrix of footbed portion 42.

Figure 13J:
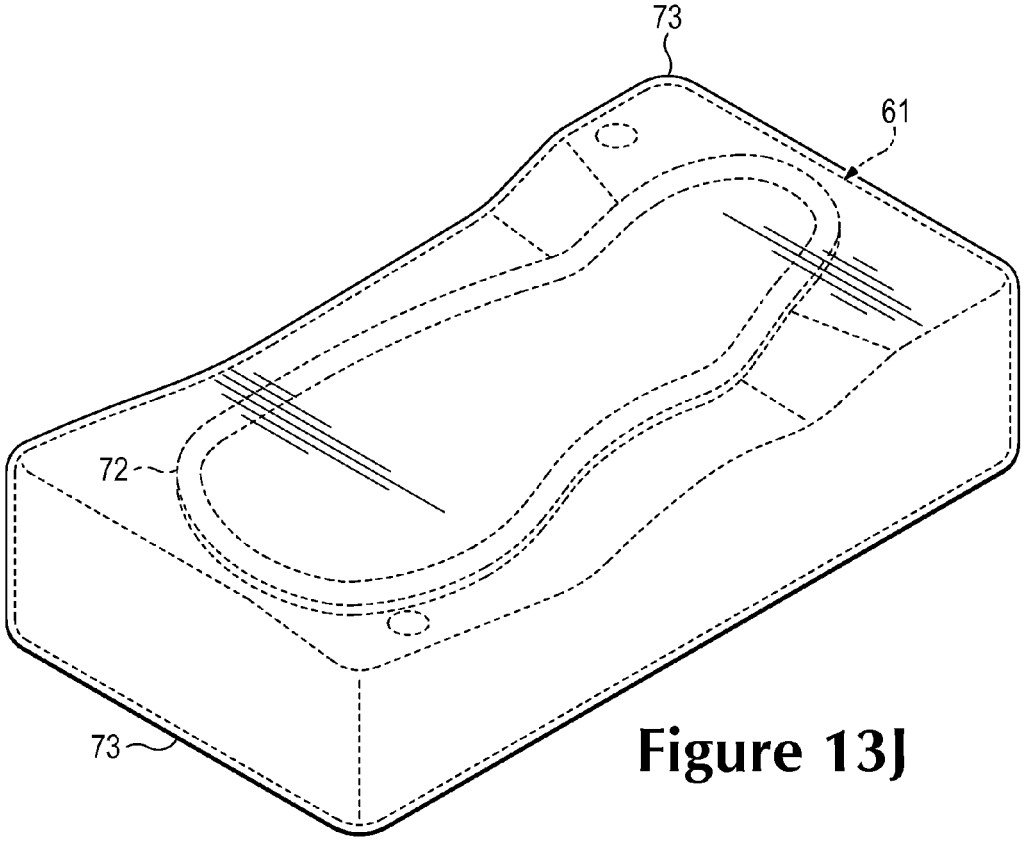
Figure 14J:
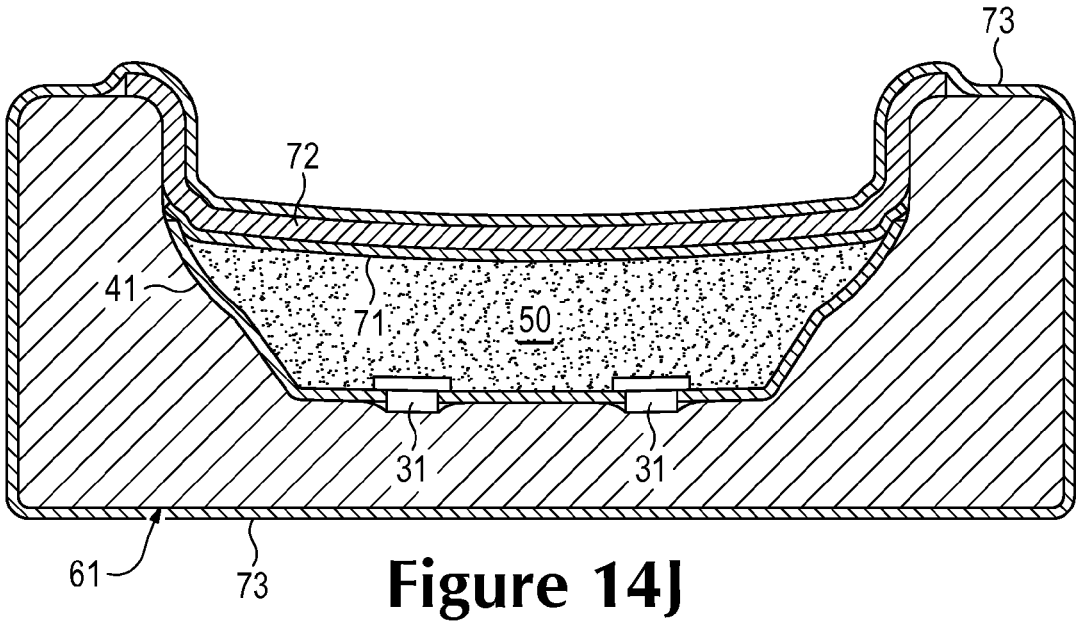

The vacuum system may be employed to ensure that additional layers 71 and the polymer resin conform to the contours of core 50, bond with a surface of ground portion 41, and minimize the presence of air pockets. Referring to FIGS. 13J and 14J, breather material 72 is positioned adjacent to layers 71 and vacuum bag 73 extends entirely around the system. Upon the application of a vacuum, air from within vacuum bag is evacuated, and the differential in pressure induces vacuum bag 73 to press layers 71 and the polymer resin against core 50. This configuration is held until the polymer resin sets, which may be in a range of twenty minutes to more than one hour. Given that the upper surface of core 50 is shaped by surface 64, forming footbed portion 42 against this surface imparts corresponding contours to footbed portion 42. A variety of other conventional systems may be utilized in place of the vacuum system, including pressure bag molding, autoclave molding, and resin transfer molding.

Figure 13K:
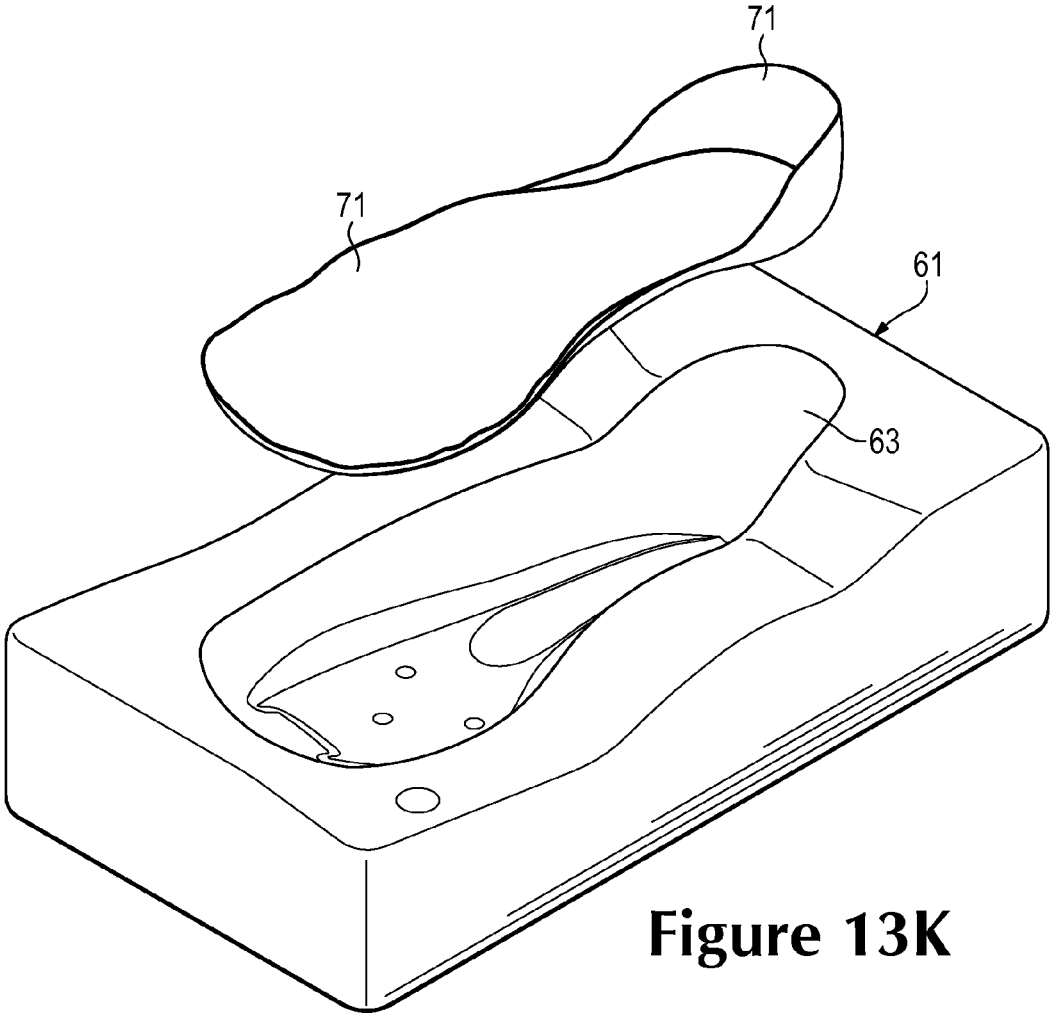
Figure 13L:
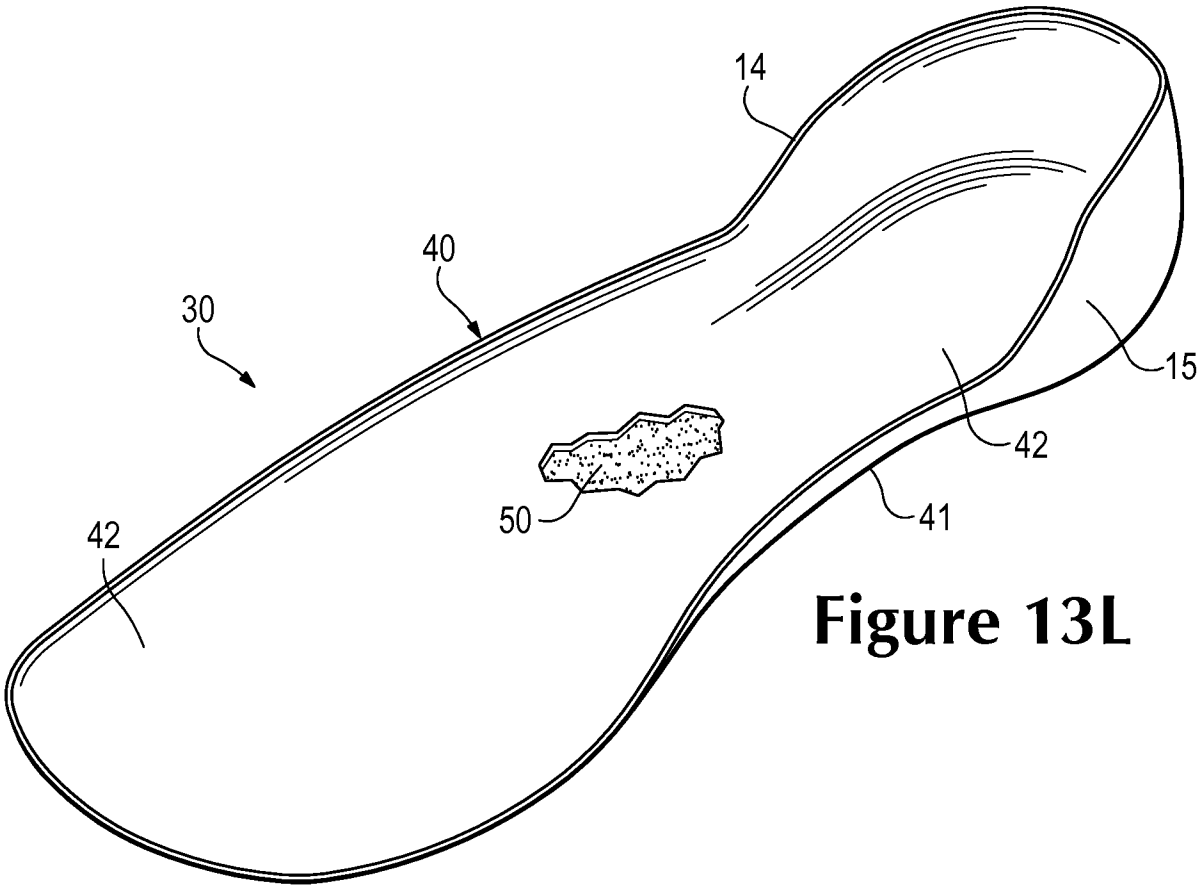
Figure 14K:
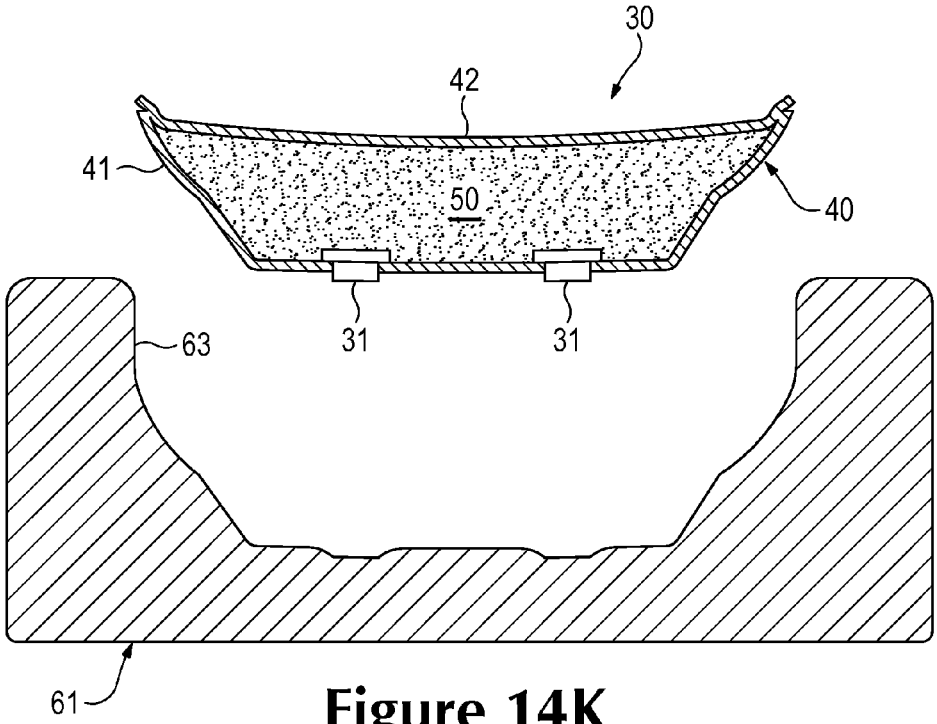

Once the polymer resin is set, vacuum bag 73 and breather material 72 may be removed. Additionally, a substantially complete sole structure 30 is removed from first mold portion 61, as depicted in FIGS. 13K and 14K. Footbed portion 42 is then sanded or smoothed to remove irregular areas, and excess material is trimmed to effectively complete the manufacture of sole structure 30, as depicted in FIG. 13L. Additionally, however, artwork, paint, and clearcoat may be applied, or other post-manufacturing steps may be taken prior to or following securing sole structure 30 to upper 20. A cleat or other device, which may or may not be considered part of footwear 10, may then be joined with mounting hardware 31.

The above discussion regarding the manufacture of sole structure 30 provides an example of a suitable process. Other processes, however, may be utilized to manufacture other configurations for sole structure 30, as in FIGS. 10A-10F. Other processes may also be utilized to mass-produce a plurality of sole structure 30. Accordingly, a variety of manufacturing processes may be utilized for sole structure 30, as well as other elements of footwear 10.

CONCLUSION

Figure 15:
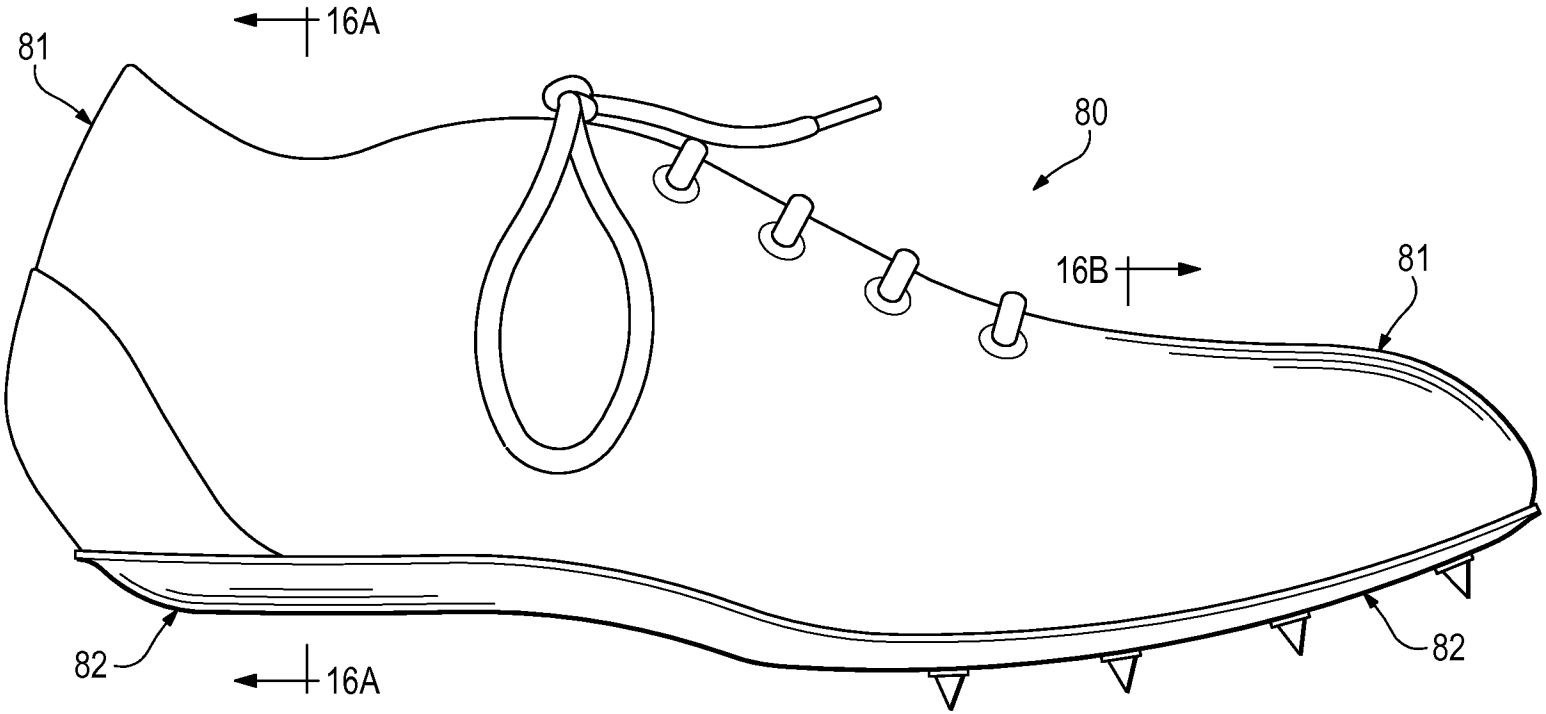
FIG. 15 is a lateral side elevational view of another article of footwear.
Figure 16A:
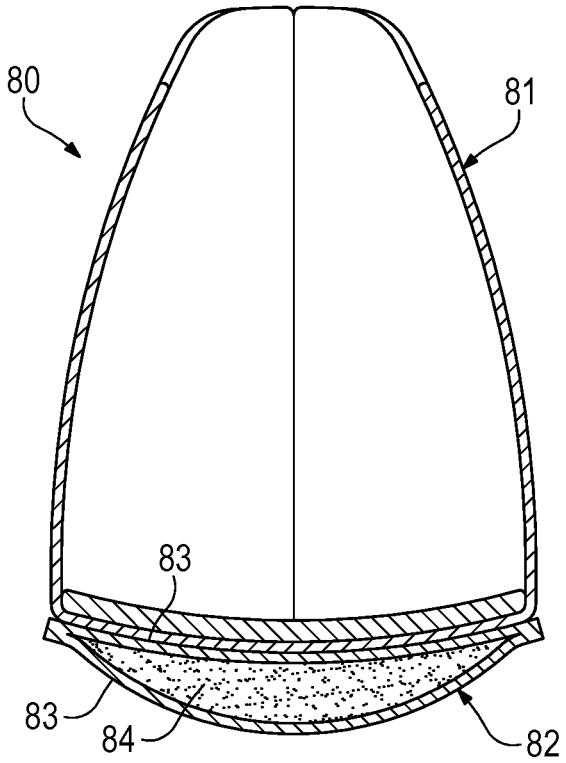
FIGS. 16A and 16B are cross-sectional views of the article of footwear depicted in FIG. 15, as defined by section lines 16A and 16B in FIG. 15.
Figure 16B:
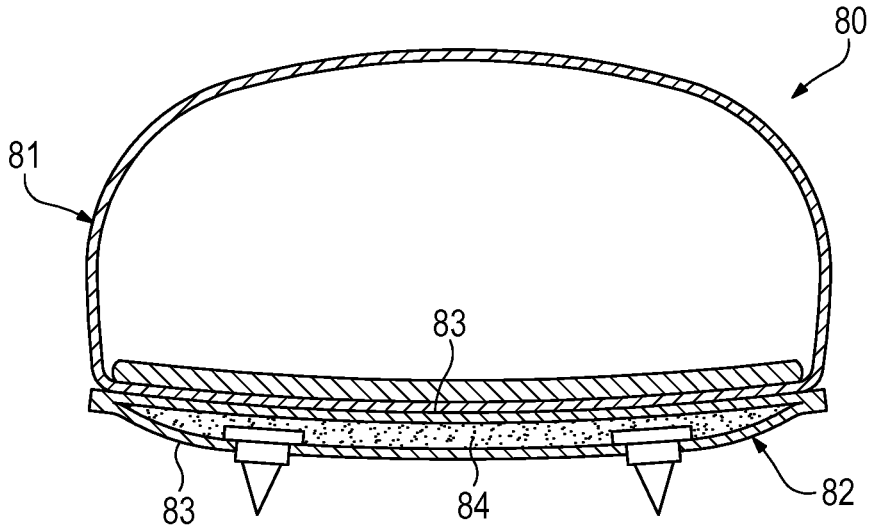

Footwear 10 provides an example of a suitable configuration for a cycling shoe. As noted above, however, the concepts disclosed herein may apply to a wide variety of footwear styles. As another example, an article of footwear 80 is depicted in FIGS. 15, 16A, and 16B as having an upper 81 and a sole structure 82. In general, footwear 80 may be utilized for sprinting or other running activities. As with sole structure 30, sole structure 82 includes a shell 83 and a core 84. The configuration of shell 83 and core 84, however, have a lower profile (i.e., thickness) that is adapted to sprinting. Accordingly, the concepts disclosed above for sole structure 30, as well as the general manufacturing process, may be utilized to form sole structures for a variety of types of footwear that are intended for various activities or purposes.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, the sole structure comprising:

a shell having a ground portion and a footbed portion, a periphery of the footbed portion being secured to the ground portion to define a cavity between the ground portion and the footbed portion, the shell being formed from a composite material;

a core located within the cavity and substantially filling the cavity, the core being formed from a polymer foam material; and mounting hardware for a cleat, the mounting hardware attached directly to the ground portion and having a top surface completely covered by the core.

2. The article of footwear recited in claim 1, wherein the shell extends around and encloses substantially all of the core.

3. The article of footwear recited in claim 1, wherein the ground portion of the shell forms at least a portion of a ground-contacting surface of the footwear.

4. The article of footwear recited in claim 1, wherein the mounting hardware extends only through the ground portion of the shell.

5. The article of footwear recited in claim 1, wherein a portion of the shell located in a heel region of the footwear extends upward and joins with the upper to form a heel counter.

6. The article of footwear recited in claim 1, wherein the ground portion of the shell forms a portion of a lower surface and a side surface of the sole structure, and the footbed portion forms a portion of an upper surface of the sole structure.

7. The article of footwear recited in claim 1, wherein the composite material of the shell includes a polymer matrix and carbon fiber reinforcement with a tensile strength greater than 0.60 gigapascals.

8. The article of footwear recited in claim 7, wherein the core directly contacts one of the polymer matrix and carbon fiber reinforcement.

9. The article of footwear recited in claim 7, wherein the fiber reinforcement includes layers of a textile, the ground portion incorporating a greater number of the layers of the textile than the footbed portion.

10. The article of footwear recited in claim 1, wherein the sole structure includes a supplemental layer that extends between the footbed portion of the shell and a lower area of the upper.

11. An article of footwear having an upper and a sole structure secured to the upper, the sole structure comprising:

a shell formed from a composite material having a polymer matrix and fiber reinforcement with a tensile strength greater than 0.60 gigapascals, the shell including:

(a) a ground portion having a convex outer surface and an opposite concave inner surface, at least a portion of the outer surface forming a portion of an exterior surface of the sole structure, (b) a footbed portion having an upper surface that faces the upper and an opposite lower surface, the footbed portion being joined to the inner surface of the ground portion to form an integral, one-piece unit, and the footbed portion extending continuously between opposite sides of the inner surface and continuously along a length of the sole structure, and (c) a cavity located between the inner surface of the ground portion and the lower surface of the footbed portion, each of the ground portion, footbed portion, and cavity extending through a majority of a length and a width of the sole structure;

a core formed from a polymer foam material, the core being located within the cavity and substantially filling the cavity; and mounting hardware extending through and attached directly to the ground portion of the shell, the core completely covering a top surface of the mounting hardware.

12. The article of footwear recited in claim 11, wherein the shell extends around and encloses substantially all of the core.

13. The article of footwear recited in claim 11, wherein the core directly contacts the top of the mounting hardware.

14. The article of footwear recited in claim 11, wherein the core directly contacts one of the polymer matrix and carbon fiber reinforcement.

15. The article of footwear recited in claim 11, wherein the ground portion extends upward and joins with the upper to form a heel counter in a heel region of the footwear.

16. The article of footwear recited in claim 11, wherein the footbed portion is contoured such that the upper surface defines a depression in a heel region of the footwear and a protruding area in a midfoot region and on a medial side of the footwear.

17. The article of footwear recited in claim 11, wherein the fiber reinforcement includes layers of a textile, the ground portion incorporating a greater number of the layers of the textile than the footbed portion.

18. An article of footwear having an upper and a sole structure secured to the upper, at least ninety percent of a mass of the sole structure comprising:

a shell formed from a composite material including a polymer matrix and fiber reinforcement with a tensile strength greater than 0.60 gigapascals, the shell having a ground portion and a footbed portion joined together to define an interior cavity;

a core formed from a polymer foam material, the core being located within the cavity and substantially filling the cavity; and mounting hardware for a cleat, the mounting hardware attached directly to the ground portion and having a top surface completely covered by the core.

19. The article of footwear recited in claim 18, wherein the shell is an integral, one-piece unit.

20. The article of footwear recited in claim 19, wherein the fiber reinforcement includes layers of a textile, the ground portion incorporating a greater number of the layers of the textile than the footbed portion.

21. The article of footwear recited in claim 18, wherein the shell extends around and encloses substantially all of the core.

22. The article of footwear recited in claim 18, wherein a portion of the shell located in a heel region of the footwear extends upward and joins with the upper to form a heel counter.

* * * * *